US006016779A

United States Patent [19]

Nemoto et al.

[11] Patent Number: 6,016,779

[45] Date of Patent: Jan. 25, 2000

[54] VALVE OPERATING SYSTEM IN INTERNAL COMBUSTION ENGINE

[75] Inventors: Hirotomi Nemoto; Shigekazu Tanaka; Shigemasa Kajiwara; Katsuaki Shiiki; Takeshi Gomi; Tetsuya Ishiguro, all of Wako, Japan

[73] Assignee: Honda Giken Kogyo Kabushiki Kaisha, Tokyo, Japan

[21] Appl. No.: 08/921,255

[22] Filed: Aug. 29, 1997

[30] Foreign Application Priority Data

Sep. 2, 1996 [JP] Japan ..... 8-232283
May 28, 1997 [JP] Japan ..... 9-138336

[51] Int. Cl.[7] ..... F01L 13/00

[52] U.S. Cl. ..... 123/90.16; 123/90.34; 123/90.39

[58] Field of Search ..... 123/90.15, 90.16, 123/90.17, 90.22, 90.33, 90.34, 90.39

[56] References Cited

U.S. PATENT DOCUMENTS

| | | | |
|---|---|---|---|
| 5,003,939 | 4/1991 | King | 123/90.16 |
| 5,018,487 | 5/1991 | Shinkai | 123/90.16 |
| 5,025,761 | 6/1991 | Chen | 123/90.16 |
| 5,148,783 | 9/1992 | Shinkai et al. | 123/90.16 |
| 5,174,253 | 12/1992 | Yamazaki et al. | 123/90.17 |
| 5,327,859 | 7/1994 | Pierik et al. | 123/90.17 |

FOREIGN PATENT DOCUMENTS

| | | |
|---|---|---|
| 56-23528 | 3/1981 | Japan . |
| 5-33840 | 2/1993 | Japan . |
| 5-79450 | 3/1993 | Japan . |
| 5-157149 | 6/1993 | Japan . |
| 6-34005 | 2/1994 | Japan . |
| 6-66360 | 3/1994 | Japan . |
| 7-107368 | 11/1995 | Japan . |
| WO 83/02301 | 7/1983 | WIPO . |

OTHER PUBLICATIONS

Patent Abstract of Japan, vol. 9, No. 128 (M–384), Jun. 4, 1985 & JP 60 011612 A.

*Primary Examiner*—Weilun Lo
*Attorney, Agent, or Firm*—Nikaido, Marmelstien, Murray & Oram LLP

[57] ABSTRACT

A valve operating system in an internal combustion engine is disclosed, wherein the operational characteristic of an engine valve which is an intake valve or an exhaust valve, can be changed in accordance with the operational state of the engine. In the valve operating system, a power transmitting means comprises an inner wheel, an outer wheel surrounding the inner wheel, and a carrier on which a planetary rotor is rotatably carried. The inner wheel is operatively connected to a cam shaft, and the outer wheel is connected to the engine valve. A rotational-amount control device is connected to the carrier for controlling the rotational amount of the carrier in accordance with the operational state of the engine. Thus, the size of the valve operating system can be reduced, and moreover, the operational characteristics of the engine valve can be finely changed.

33 Claims, 15 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine, and more particularly, to a valve operating system in an internal combustion engine, in which the operational characteristic of an engine valve which is an intake valve or an exhaust valve, can be changed in accordance with the operational state of the engine.

2. Description of the Related Art

Such a valve operating system is already known, for example, from Japanese Patent Publication No. 7-107368.

The known valve operating system is constructed so that rocker arms connected to the engine valves, are alternatively switched and driven by a plurality of types of valve operating cams having different cam profiles, wherein the operational characteristic of the engine valves are switched at two or three states in accordance with the operational state of the engine. However, to further enhance the engine performance such as the output torque from the engine, the fuel consumption and the nature of the exhaust gas, it is desirable that the operational characteristic of the engine valves can be finely switched in accordance with the operational state of the engine. In the construction of the known valve operating system, a large number of valve operating cams having the different cam profiles are required, resulting in an increased size of the valve operating system, and hence, it is difficult to realize the valve operating system.

SUMMARY OF THE INVENTION

Accordingly, it is an object of the present invention to provide a valve operating system in an internal combustion engine, whose size can be reduced, and in which the operational characteristic of the engine valve can be finely changed.

To achieve the above object, according to a first aspect and feature of the present invention, there is provided a valve operating system in an internal combustion engine in which the operational characteristic of an engine valve can be changed in accordance with the operational state of the engine. The valve operating system comprises a power transmitting means having three components; an inner wheel capable of being rotated about an axis; an outer wheel capable of being rotated about the same axis as the inner wheel and surrounding the inner wheel; a carrier in which a planetary rotor disposed between the inner and outer wheels, is carried for rotational about an axis parallel to the axes of the inner and outer wheels. The carrier is rotated in operative association with the revolution of the planetary rotor about the inner wheel. One of the three components of the power transmitting means is operatively connected to a valve operating cam on a cam shaft in which a manner that it can be rotated in response to the rotational of the cam shaft, another of the three components is connected to the engine valve, and a rotational-amount control means is connected to the remaining or third one of the three components for controlling the rotational amount of that third component in accordance with the operational state of the engine.

With the first feature of the present invention, among the three components of the power transmitting means, the first and second components are operatively connected to the valve operating cam on the cam shaft and to the engine valve, respectively, and the rotational amount of the third component is controlled by the rotational-amount control means. Thus, the rotation of the second component corresponding with the rotation of the first component provided by the rotation of the cam shaft, i.e., the operational characteristic of the engine valve, is controlled. Therefore, by finely controlling the rotational amount of the third component, the operational characteristic of the engine valve can be more finely controlled. Moreover, by the fact that the power transmitting means is constructed so that the three components, i.e., the inner and outer wheels and the carrier are disposed for rotation about the same axis, the power transmitting means can be formed compactly, thereby providing a reduction in size of the valve operating system.

According to a second aspect and feature of the present invention, in addition to the first feature, the power transmitting means is a planetary gear type comprised of a sun gear which is the inner wheel, a ring gear which is the outer wheel, and the carrier on which a planetary gear which is the planetary rotor, is rotatably carried. With such second feature, the operational characteristic of the engine valve can be accurately controlled by the mutual meshing connection of the components forming the power transmitting means.

According to a third aspect and feature of the present invention, in addition to the second feature, the engine valve is connected to the ring gear; an arm connected to the sun gear and extending toward the cam shaft is disposed axially on one side of the ring gear; the valve operating cam, with which a tip end of the arm is in contact, is provided on the cam shaft which has an axis parallel to the axis of the power transmitting means; and the rotational-amount control means is connected to the carrier. With the third feature, the cam shaft can be disposed in proximity to the power transmitting means while avoiding interference between the valve operating cam and the ring gear, thereby increasing the degree of freedom for the location of the cam shaft.

According to the fourth aspect and feature of the present invention, in addition to the third feature, the cam shaft is disposed at a location where the projection of the locus of rotation of the outer most end of the valve operating cam intersects an outer peripheral surface of the ring gear as viewed in the axial direction of the cam shaft. With the fourth feature, the cam shaft can be disposed in closer proximity to the axis of the power transmitting means, thereby providing compactness of the valve operating system.

According to a fifth aspect and feature of the present invention, in addition to the first feature, the engine valve is biased in a closing direction by a resilient force increased in accordance with the operation of the engine valve in an opening direction; the rotational-amount control means applies a changeable force to the third component, opposing a reaction force transmitted to the third component through the another component; and an auxiliary-force applying means is connected to the third component and adapted to provide a portion of the force opposing the reaction force. With the fifth feature, an actuator adapted to vary the force exhibited by the control of fluid pressure or the amount of electrical input, can be used as the rotational-amount control means and thus, the rotational-amount control means can be easily constructed. Moreover, by the fact that the auxiliary-force applying means is connected to the third component, the force exhibited by the rotational-amount control means can be set at a relatively small value, thereby providing a reduction in size of the rotational-amount control means.

According to a sixth aspect and feature of the present invention, in addition to the first feature, the rotational-amount control means includes an operating member which is connected to the third component to control the rotational amount of the third component, wherein the operational amount is detected by a detecting means. With the sixth feature, the operational amount of the operating member, i.e., the rotational amount of the still another component and the operational amount of the engine valve can be directly detected, and the operational characteristics of the engine valve can be controlled with a high degree of accuracy in accordance with the operational state of the engine by a feedback control using a detected value detected by the detecting means.

According to a seventh aspect and feature of the present invention, in addition to the sixth feature, the detecting means is mounted on the rotational-amount control means. With the seventh feature, the detecting means and the rotational-amount control means can be disposed in a compact arrangement.

According to an eighth aspect and feature of the present invention, in addition to the second feature, the power transmitting means is mounted between the cam shaft and a plurality of the engine valves. With the eighth feature, the operational characteristics of the plurality of engine valves can be finely controlled by a single power transmitting means, thereby reducing the size of the valve operating system.

According to a ninth aspect and feature of the present invention, in addition to the eighth feature, the plurality of engine valves are disposed in a row in a direction parallel to the axis of the cam shaft, and the ring gear of the power transmitting means is disposed between the engine valves at opposite ends in the direction of the arrangement of the engine valves as viewed in a direction perpendicular to the axis of the cam shaft. With the ninth feature, it is possible to compactly construct the valve operating system in which the power transmitting means does not protrude from the opposite ends in the direction of arrangement of the engine valves in the direction parallel to the axis of the cam shaft, and the operational characteristics of the plurality of engine valves can be changed by the single power transmitting means.

According to a tenet aspect and feature of the present invention, in addition to the second feature, a single power transmitting means is mounted between the cam shaft and a pair of the engine valves arranged in a direction parallel to the axis of the cam shaft, and includes the ring gear disposed between the pair of engine valves as viewed in a direction perpendicular to the axis of the cam shaft. With the tenth feature, it is possible to construct the valve operating system compactly in such a manner that the operational characteristics of the pair of engine valves can be finely controlled by the single power transmitting means, and the power transmitting means does not protrude from the opposite ends in the direction of arrangement of the pair of engine valves in the direction parallel to the axis of the cam shaft.

According to an eleventh aspect and feature of the present invention, in addition to the first feature, the outer wheel as the one component, is operatively connected to the valve operating cam on the cam shaft for rotation in response to the rotation of the cam shaft; the inner wheel as the another component is connected to the engine valve; and the rotational-amount control means is connected to the carrier as the third component. With the eleventh feature, the rotational amount of the outer wheel operatively connected to the cam shaft is smaller than the rotational amount of the inner wheel operatively connected to the engine valve, and the size of the valve operating cam suitable for the lift amount required for the engine valve, i.e., for the rotational amount of the inner wheel, can be set relatively small, thereby reducing the load received from the valve operating cam by the outer wheel which helps to alleviate the valve operating load. Further, from the fact that the valve operating cam is relatively small, the space required for the rotation of the valve operating cam as well as the space required for the operation of the operatively connected portion of the outer wheel to the valve operating cam is also relatively small and hence, it is possible to provide compactness to the valve operating chamber in which the valve operating system is disposed.

According to a twelfth aspect and feature of the present invention, in addition to the eleventh feature, the power transmitting means is a planetary gear type comprised of a sun gear which is the inner wheel, a ring gear which is the outer wheel, and a carrier on which a planetary gear that is the planetary rotor, is rotatably carried. With the twelfth feature, the operational characteristic of the engine valve can be accurately controlled by the mutual meshing connection of the components forming the power transmitting means.

According to a thirteenth aspect and feature of the present invention, in addition to the eleventh feature, the cam shaft is disposed at a location below upper ends of the intake and exhaust vales and between the intake and exhaust valves, and the point of operative connection of the valve operating cam and the outer wheel with each other is disposed between the cam shaft and one of the intake and exhaust valves, which is the engine valve operatively connected to the inner wheel, so that the operational characteristic thereof can be changed. With the thirteenth feature, the power transmitting means can be disposed in proximity to the upper surface of the cylinder head, whereby the valve operating chamber can be made compact.

According to a fourteenth aspect and feature of the present invention, in addition to the thirteenth feature, an oil bath is defined in an upper surface of a cylinder head, and the valve operating cam is immersed in oil within the oil bath. With the fourteenth feature, the lubrication of the power transmitting means can be satisfactorily performed in a manner that the oil is raked up by the valve operating cam.

According to a fifteenth aspect and feature of the present invention, in addition to the eleventh feature, the single outer wheel is disposed between a pair of the engine valves adjacent each other in the axial direction of the cam shaft, and the engine valves are operatively connected to the inner wheel on axially opposite sides of the outer wheel. With the fifteenth feature, the pair of engine valves can be opened and closed by the power transmitting means compactly disposed between both the engine valves, wherein the operational characteristic thereof can be changed. Thus, the valve operating system can be made more compactly.

According to a sixteenth aspect and feature of the present invention, in addition to the eleventh feature, the power transmitting means is disposed in such a manner that a portion of the outer wheel is superimposed, as viewed in an axial direction of the outer wheel, on a portion of a coiled valve spring which surrounds an upper portion of the engine valve to exhibit a spring force for biasing the engine valve in a closing direction. With the sixteenth feature, the power transmitting means can be disposed in further proximity to the engine valve, whereby the valve operating chamber can be made compact.

According to a seventeenth aspect and feature of the present invention, in addition to the first feature, the axes of the inner and outer wheels are disposed between the cam shaft and the engine valve in parallel to the cam shaft. With the seventeenth feature, each of the cam shaft and the engine valve can be formed into a conventionally used common structure, and need not be of a special structure.

According to an eighteenth aspect and feature of the present invention, there is provided a valve operating system in an internal combustion engine, in which the operational characteristic of an engine valve can be changed in accordance with the operational state of the engine. The valve operating system comprises a power transmitting means which is mounted between a valve operating cam on a cam shaft and an engine valve. The power transmitting means is a planetary gear type which includes a sun gear capable of being rotated about an axis, a ring gear capable of being rotated about the same axis as the sun gear and surrounding the sun gear, and a carrier on which a planetary gear is disposed between the sun gear and the ring gear, and is carried for rotation about an axis parallel to the axes of the sun gear and the ring gear. The carrier is rotated in operative association with the revolution of the planetary gear about the sun gear. A control means controls the amount of power transmitted between the valve operating cam and the engine valve by the power transmitting means in accordance with the operational state of the engine. With such arrangement, the operational characteristics of the engine valve can be accurately controlled using the power transmitting means of the planetary gear type constructed compactly by the fact that the sun gear and the planetary gear are connected in a meshed manner to each other, and the ring gear and the planetary gear are connected in a meshed manner to each other.

According to a nineteenth aspect and feature of the present invention, in addition to the eighteenth feature, the axes of the sun gear and the ring gear are disposed between the cam shaft and the engine valve in parallel to the cam shaft. With the nineteenth feature, each of the cam shaft and the engine valve can be formed into a conventionally used common structure, and need not be of a special structure.

According to a twentieth aspect and feature of the present invention, there is provided a valve operating system in an internal combustion engine, in which the operational characteristics of an engine valve can be changed in accordance with the operational state of the engine. The valve operating system comprises a first power transmitting member driven in rotation by a valve operating cam on a cam shaft, a second power transmitting member which is rotated about the same axis as the first power transmitting member in a plane perpendicular to the rotational axis of the first power transmitting member and which is adapted to drive the engine valve, and a control means capable of continuously changing the amount of power transmitted between the first and second power transmitting members in accordance with the operational state of the engine. With the twentieth feature, the first and second power transmitting members and the control means mounted between the power transmitting members can be arranged compactly to provide a reduction in size of the valve operating system, and the operational characteristic of the engine valve can be continuously changed.

According to a twenty-first aspect and feature of the present invention, in addition to the twentieth feature, the rotational axes of the first and second power transmitting members are disposed between the cam shaft and the engine valve in parallel to the cam shaft. With the twenty-first feature, each of the cam shaft and the engine valve can be formed into a conventionally used common structure, and need not be of a special structure.

Further, according to a twenty-second aspect and feature of the present invention, in addition to the twentieth feature, a planetary gear mechanism is mounted between the first and second power transmitting members, and the control means is connected to one of the components of the planetary gear mechanism, which is different from the components connected to the first and second power transmitting members, to control the operational amount of the particular component. With the twenty-second feature, the operational characteristic of the engine valve can be accurately controlled using the planetary gear mechanism constructed compactly.

The above and other objects, features and advantages of the invention will become apparent from the following description of the preferred embodiments taken in conjunction with the accompanying drawings.

DETAILED DESCRIPTION OF THE PREFERRED EMBODIMENTS

The present invention will now be described by way of embodiments with reference to the accompanying drawings.

Figure 1:
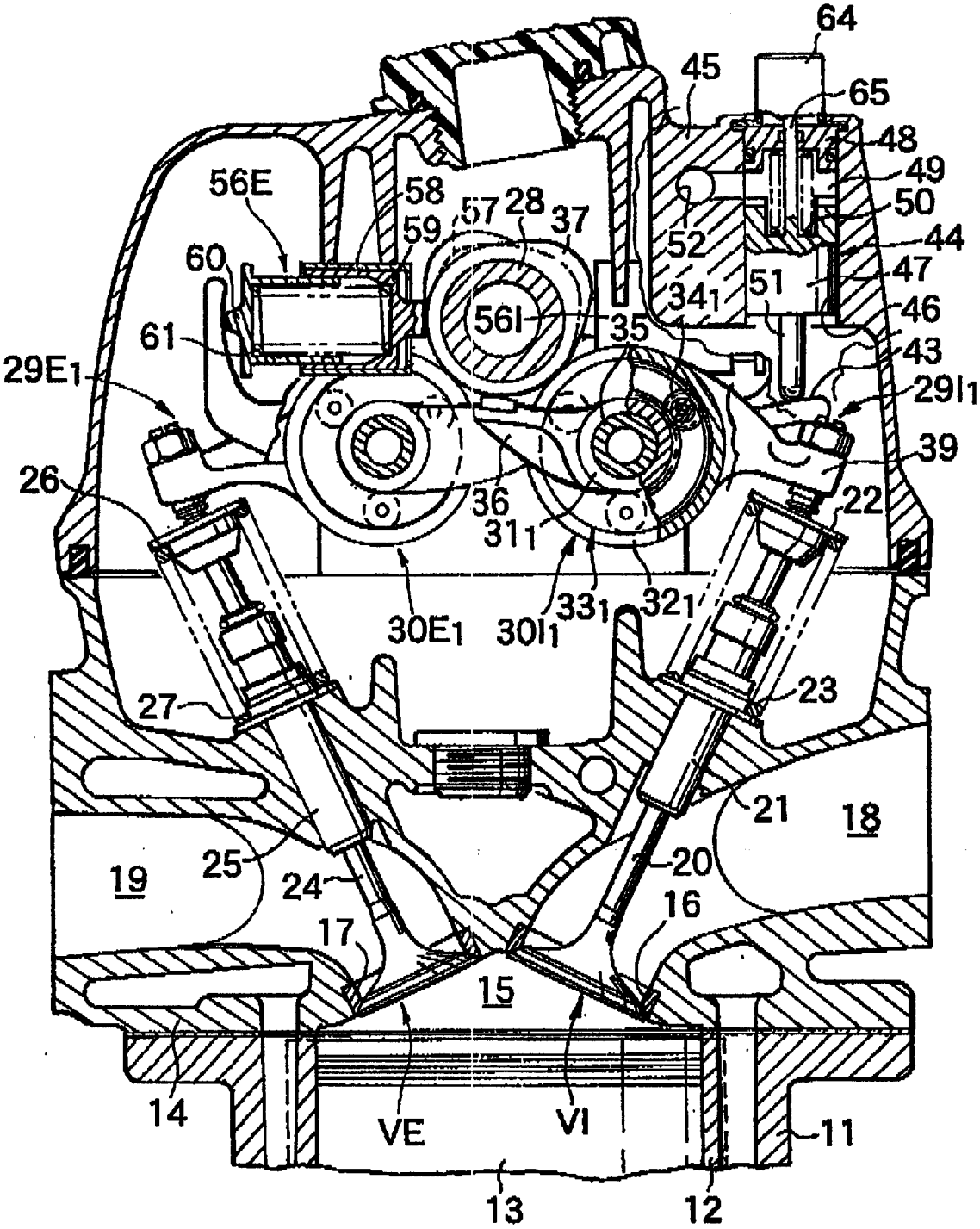
FIG. 1 is a vertical sectional view of an essential portion of an internal combustion engine.

A first embodiment of the present invention will be described with reference to FIGS. 1 to 6. Referring first to FIG. 1, a piston 13 is slidably received in a cylinder 12 provided in a cylinder block 11, and a combustion chamber 15 is defined between an upper surface of the piston 13 and a cylinder head 14. A pair of intake valve bores 16 and a pair of exhaust valve bores 17 are provided in the cylinder head 14, so that they open into an upper surface of the combustion chamber 15. The intake valve bores 16 communicate with an intake port 18, and the exhaust valve bores 17 communicate with an exhaust port 19.

A pair of intake valves VI capable of individually opening and closing the intake valve bores 16, have stems 20 slidably fitted into guide tubes 21 provided in the cylinder head 14. Coiled valve springs 23 are mounted between retainers 22 at upper ends of the stems 20 which protrude upwards from the guide tubes 21 and the cylinder head 14, to surround the stems 20, so that the intake valves VI are biased by the valve springs 23 in a direction to close the intake valve bores 16. A pair of exhaust valves VE capable of individually opening and closing the exhaust valve bores 17, are slidably fitted into guide tubes 25 provided in the cylinder head 14. Coiled valve springs 27 are mounted between retainers 26 at upper ends of the stems 24 which protrude upwards from the guide tubes 25 and the cylinder head 14, to surround the stems 24, so that the exhaust valves VE are biased by the valve springs 27 in a direction to close the exhaust valve bores 17.

A cam shaft 28 parallel to an axis of a crankshaft (not shown) is rotatably disposed between the intake valves VI and the exhaust valves VE and is operatively connected to the crankshaft at a reduction ratio of ½. An intake valve operating device 29I$_1$ is mounted between the intake valves VI and the cam shaft 28 for converting the rotating movement of the cam shaft 28 into an opening/closing operation of the intake valves VI. An exhaust-side valve operating device 29E$_1$ is mounted between the exhaust valves VE and the cam shaft 28 for converting the rotating movement of the cam shaft 28 into an opening/closing movement of the exhaust valves VE.

Figure 2:
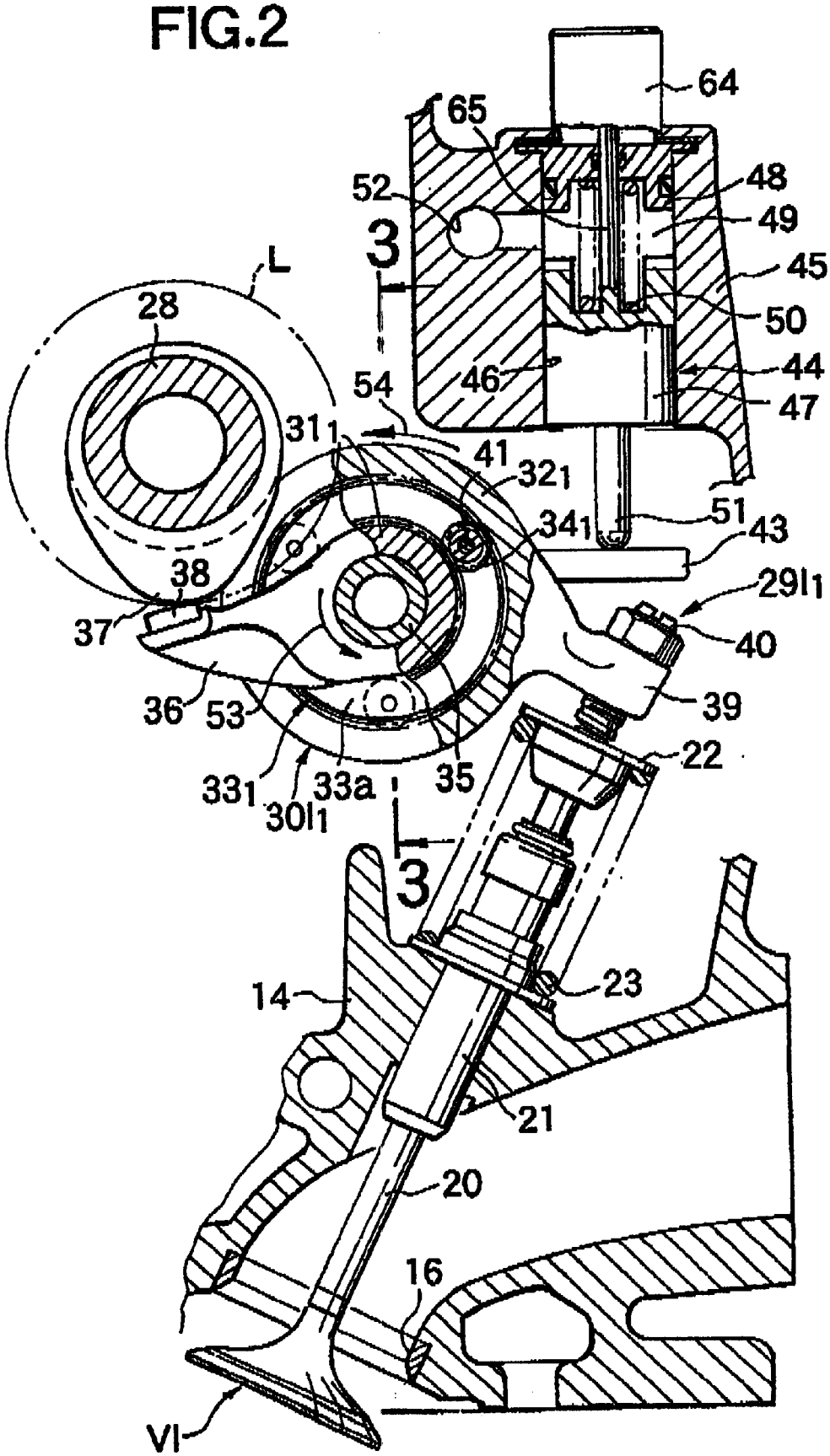
FIG. 2 is an enlarged view of the essential portion shown in FIG. 1.
Figure 3:
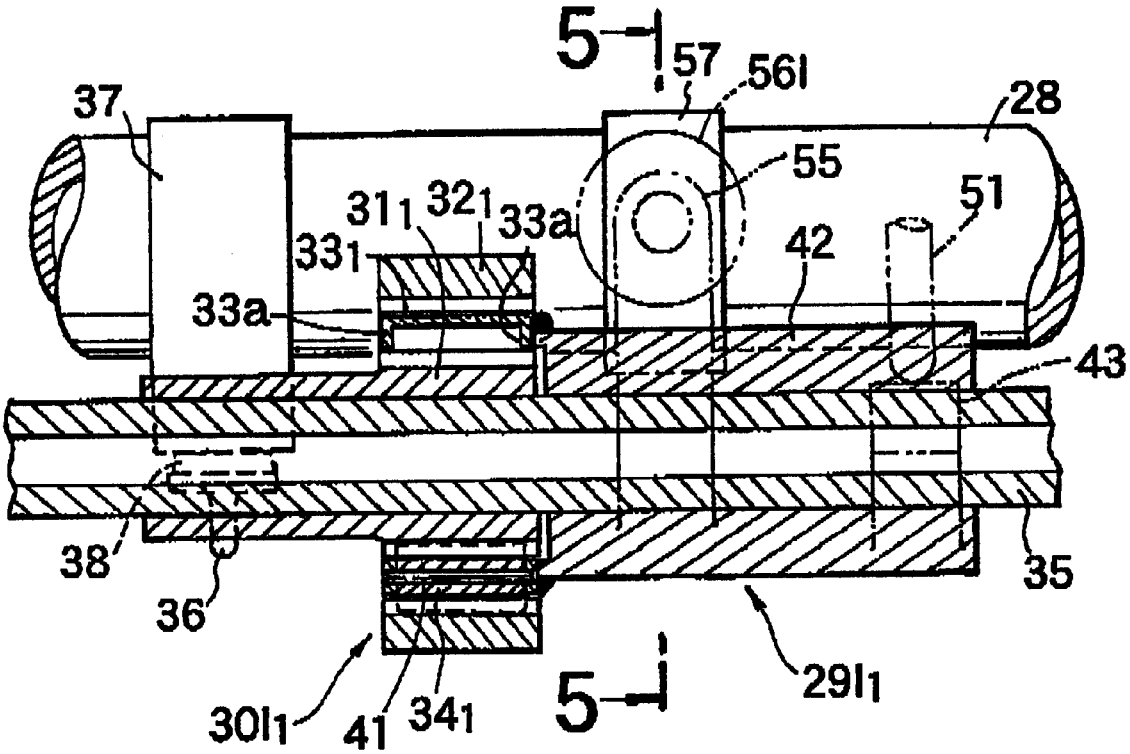
FIG. 3 is a sectional view taken along a line 3—3 in FIG. 2.
Figure 4:
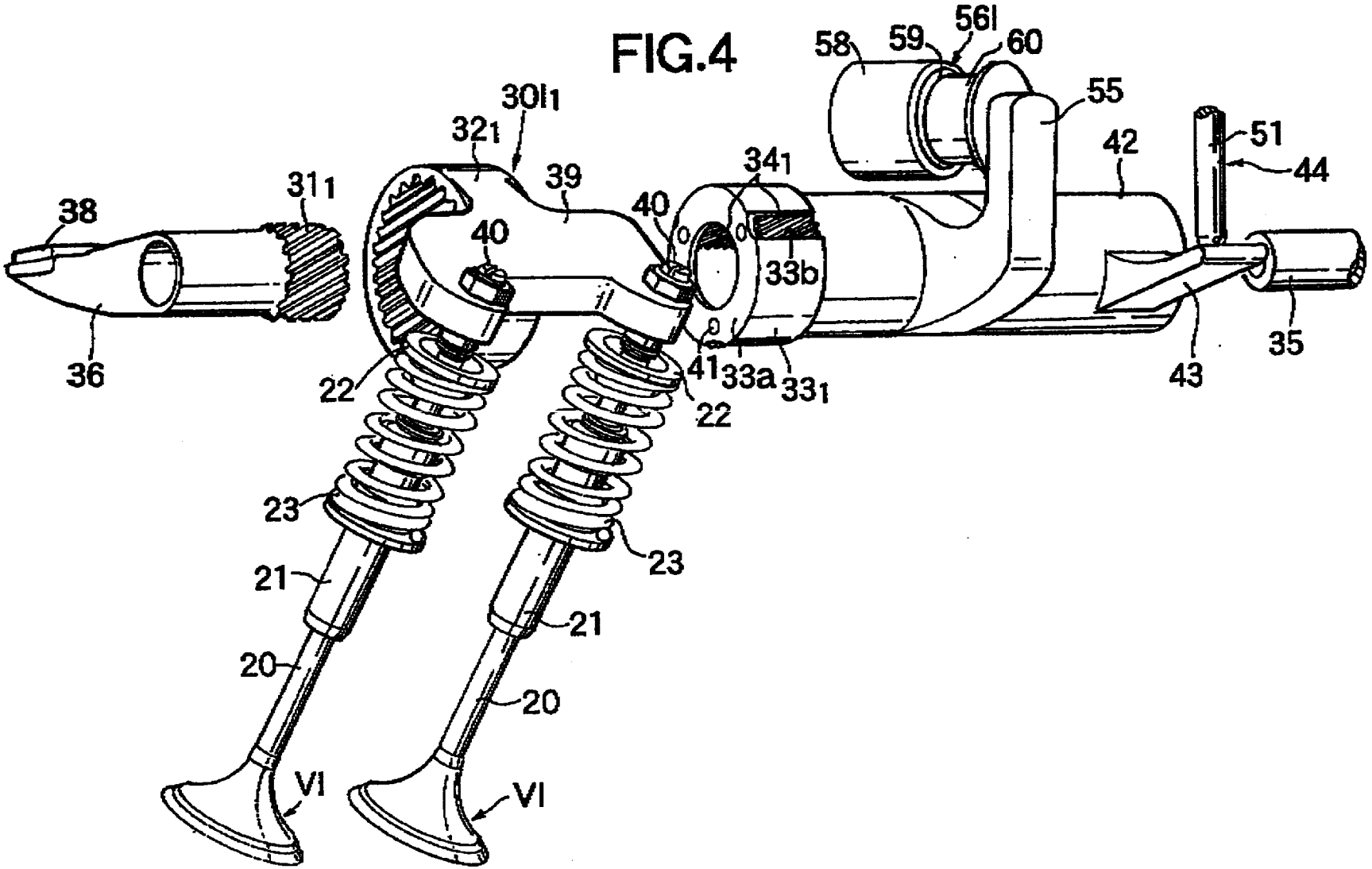
FIG. 4 is an exploded perspective view of an intake valve operating device.

Referring also to FIGS. 2 to 4, the intake valve operating device 29I$_1$ includes a power transmitting means 30I$_1$ which is formed into a planetary gear type by a sun gear 31$_1$ which is an inner wheel rotatable about an axis, a ring gear 32$_1$ which is an outer wheel surrounding the sun gear 31$_1$ for rotation about the same axis as that of the sun gear 31$_1$, and a carrier 33$_1$ which carries a plurality of planetary gears 34$_1$ which are planetary rotors for rotation about an axis parallel to axes of the sun gear 31$_1$ and the ring gear 32$_1$, and which are rotated in operative association with the rotation of the planetary gears 34$_1$ about the sun gear 31$_1$. The power transmitting means 30I$_1$ is mounted between the cam shaft 28 and the intake valves VI in such a manner that the ring gear 32$_1$ is disposed between the intake valves VI in a direction parallel to the axis of the cam shaft 28, as viewed from a direction perpendicular to the axis of the cam shaft 28.

The sun gear 31$_1$, the ring gear 32$_1$ and the carrier 33$_1$ are three components forming the power transmitting means 30I$_1$. The sun gear 31$_1$ is rotatably carried on a support shaft 35 which is fixedly disposed between the cam shaft 28 and the intake valves VI and has an axis parallel to the cam shaft 28. An arm 36 integrally connected to one side of the sun gear 31$_1$ and extending toward the cam shaft 28 is disposed on one side of the ring gear 32$_1$, and provided at its tip end with a cam slipper 38 which is in contact with a valve operating cam 37 provided on the cam shaft 28. Thus, the sun gear 31$_1$ is operatively connected to the cam shaft 28 and driven in rotation by the valve operating cam 37 in response to the rotation of the cam shaft 28.

The ring gear 32$_1$ which is one of the components of the power transmitting means 30I$_1$ is integrally provided with a connecting arm 39 which is bifurcated and extends toward the intake valves VI. A pair of tappet screws 40 are connected to the upper ends of the stems 20 of the intake valves VI, respectively and are threadedly engaged with tip ends of the connecting arm 39 for advancing and retreating movements. Thus, the ring gear 32$_1$ is operatively connected to the intake valves VI, so that the intake valves VI are opened and closed in response to the turning of the ring gear 32$_1$.

Moreover, the cam shaft 28 is disposed in such a manner that the projection of the rotational locus L described by the outermost end of the valve operating cam 37 on the cam shaft 28 intersects an outer peripheral surface of the ring gear 32$_1$ as viewed from an axial direction of the cam shaft 28.

The carrier 33$_1$ which is the third component of the power transmitting means 30I$_1$ is cylindrical in shape having inward-turned collars 33*a* at opposite ends thereof, and is coaxially inserted between the sun gear 31$_1$ and ring gear 32$_1$. The planetary gears 34$_1$ meshed with an outer periphery of the sun gear 31$_1$ and an inner periphery of the ring gear 32$_1$ are rotatably carried on shafts 41 which are disposed at a plurality of points, e.g., three points equally spaced apart from each other in a circumferential direction of the carrier 33$_1$ and which are mounted between both the inward-turned collars 33*a*. The carrier 33$_1$ is provided with openings 33*b*, in which a portion of each of the planetary gears 34$_1$ faces, so that the planetary gears 34$_1$ are meshed with the inner periphery of the ring gear 32$_1$.

A cylindrical member 42 rotatably supported by a support shaft 35 is secured at one end thereof to the carrier 33$_1$ on the opposite side of the sun gear 31$_1$ from the arm 36, and a control arm 43 having one side facing upwards, is integrally provided at the other end of the cylindrical member 42 on the opposite side from the cam shaft 28. A rotational-amount control means 44 is disposed in a head cover 45 at a location above the control arm 43 and in contact with one surface thereof, i.e., an upper surface of the control arm 43.

The rotational-amount control means 44 includes a piston 47 slidably received in a cylinder bore 46 provided in the head cover 45 to extend vertically, and a lid member 48 which is fixed to the head cover 45 to seal the upper end of the cylinder bore 46 which defines a hydraulic pressure chamber 49 between the lid member 48 and the piston 47. A return spring 50 is mounted between the lid member 48 and the piston 47 to exhibit a spring force for biasing the piston 47 downwards. A control rod 51 as an operating member coaxially provided at a lower end of the piston 47, contacts an upper surface of the control arm 43.

An oil passage 52 is provided in the head cover 45 to lead to the hydraulic pressure chamber 49 and is connected to a hydraulic pressure source through a control valve which is not shown, so that oil which continuously varies in pressure depending upon the operational state of the engine, can be supplied to the hydraulic pressure chamber 49.

The sun gear 31$_1$ is rotated in a direction shown by an arrow 53 in FIG. 2 by the valve operating cam 37 pushing on arm 36. However, a relatively large spring load, for example, of about 20 kgf, is applied to the intake valves VI and the ring gear 32$_1$ by the valve springs 23 and hence, when the rotation of the carrier 33$_1$ about the sun gear 31$_1$ is not controlled by the rotational-amount control means 44, the carrier 33$_1$ is freely rotated in a direction 54 opposite from the arrow 53 (see FIG. 2), and the intake valves VI cannot be opened and closed. However, when the rotation of the carrier 33$_1$ about the sun gear 31$_1$ has been controlled, each of the planetary gears 34$_1$ is rotated about its axis by an amount corresponding to a controlled rotational amount to cause the rotation of the ring gear 32$_1$, thereby opening the intake valves VI. Thus, the maximum lift amount and the opening timing, i.e., the operational characteristic of the intake valves VI can be changed continuously by continuously changing the controlled rotational amount of the carrier $33_1$.

The rotational-amount control means 44 continuously controls the rotational amount of the carrier $33_1$ about the sun gear $31_1$. Thus, whereas the spring forces of the valve springs 23 for biasing the intake valves VI in closing directions are applied to the carrier $33_1$ through the planetary gears $34_1$ to bias the control arm 43 upwards, a force for urging the control arm 43 downwards can be continuously changed. The spring forces of the valve springs 23 are increased in accordance with the operation of the intake valves VI in opening directions, and the force for urging the control arm 43 upwards is also increased in accordance with the opening operation of the intake valves VI in opening directions. Therefore, the changing of the force exhibited by the rotational-amount control means 44 ensures that when the intake valves VI are opened to a certain opening degree, the forces applied to the control arm 43 from above and below are balanced with each other. Thus, the rotational amount of the carrier $33_1$ is controlled to such position, and the maximum lift position of the intake valves VI is controlled to the position in which the forces have been balanced with each other, as described above.

The spring forces of the valve springs 23 are relatively large, as described above, If the force opposing such spring forces of the valve springs 23 is born by only the rotational-amount control means 44, it leads to an increase in size of the rotational-amount control means 44. Therefore, an auxiliary control arm 55 is integrally provided on an intermediate portion of the cylindrical member 42 connected to the carrier $33_1$ in such a manner that it is opposed sideways to the cam shaft 28 on the opposite side of the cylindrical member 42 from the cam shaft 28. An auxiliary-force applying means 56I is connected to the auxiliary control arm 55.

Figure 5:
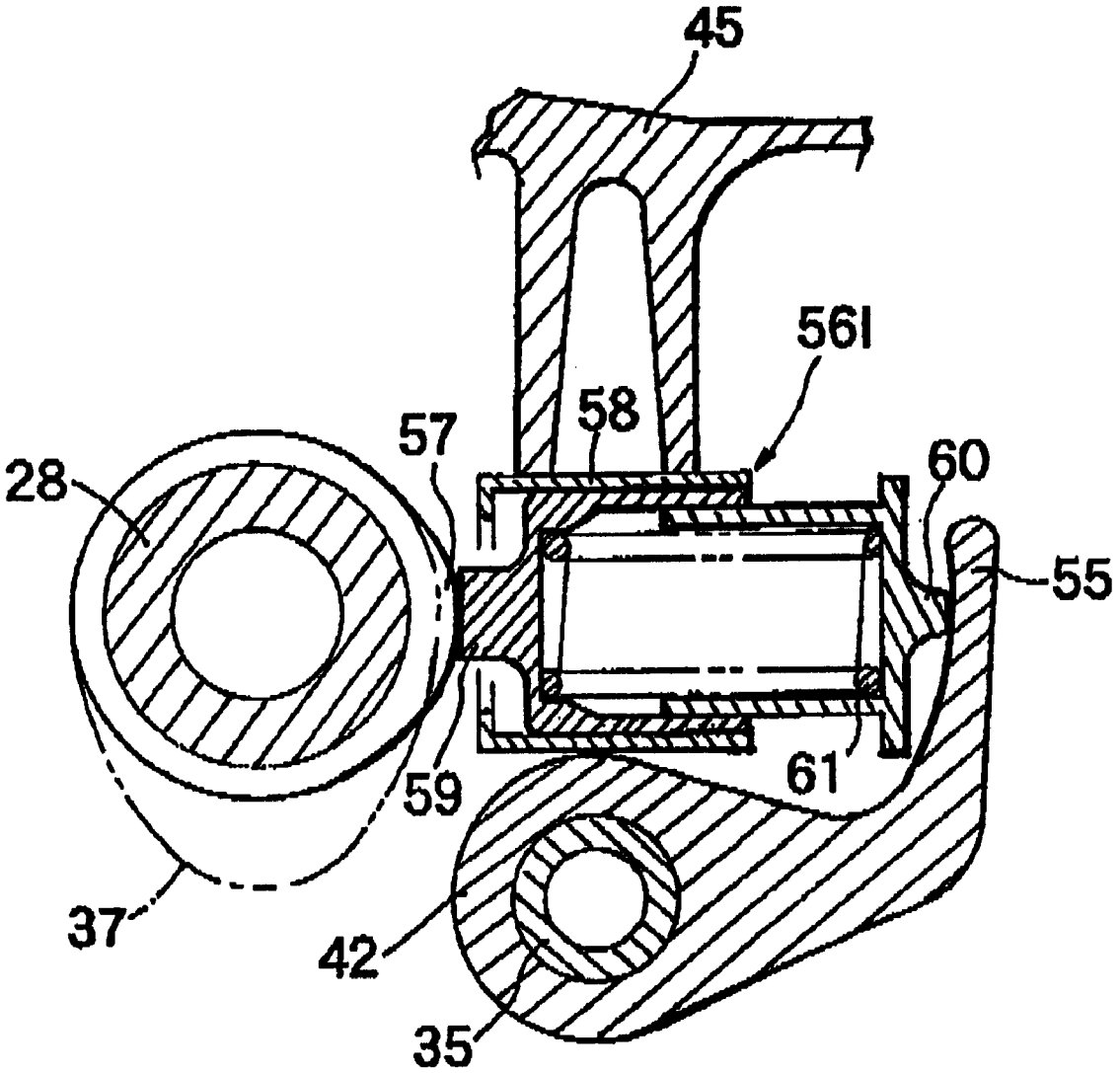
FIG. 5 is a sectional view taken along a line 5—5 in FIG. 3.

Referring to FIG. 5, an auxiliary cam 57 is fixedly provided on the cam shaft 28 at a location corresponding to the auxiliary control arm 55, and the auxiliary-force applying means 56I is disposed between the auxiliary cam 57 and the auxiliary control arm 55. The auxiliary-force applying means 56I includes a support tube 58 fixedly supported on the head cover 45 above the cylindrical member 42 and having an axis perpendicular to the axis of the cam shaft 28. A first bottomed cylindrical piston 59 is slidably received in the support tube 58 with its closed end being in sliding contact with the auxiliary cam 57, and a second piston 60 is relatively slidably fitted in the first piston 59 with its closed end being in sliding contact with the auxiliary control arm 55. A coiled spring 61 which is mounted between the first and second pistons 59 and 60, exhibits a spring force in a direction to move the pistons 59 and 60 away from each other.

With such auxiliary-force applying means 56I, the spring 61 is compressed by the urging of the first piston 59 which is controlled by the auxiliary cam 57, and the spring force of the compressed spring 61 is applied to the auxiliary control arm 55 and thus to the carrier $33_1$ through the second piston 60 in the same direction as the control force from the rotational-amount control means 44. Thus a portion of the force opposing the spring forces of the valve springs 23 can be born by the auxiliary-force applying means 56I.

It is required that the auxiliary force of the auxiliary-force applying means 56I is synchronized with the time of opening of the intake valves VI. The auxiliary cam 57 is fixedly provided on the cam shaft 28 at a location displaced from the valve operating cam 47, for example, through 90° in the circumferential direction of the cam shaft 28, so that the urging force is exerted from the auxiliary cam 57 to the first piston 59, when a rotating power is transmitted from the valve operating cam 37 to the sun gear $31_1$.

In the rotational-amount control means 44, the control rod 51 is axially operated to a position in which the force exhibited by the rotational-amount control means 44 is balanced with the force of the control arm 43 pushed up by the spring forces of the valve springs 23. If the amount of operation or movement of the control rod 51 is detected, the state in which the forces are balanced with each other, i.e., the maximum lift positions of the intake valves VI can be detected. Therefore, a lift sensor 64 which functions as a detecting means, is mounted on the lid member 48 in the rotational-amount control means 44, and a detecting rod 65 is integrally provided at an upper end of the piston 47 in the rotational-amount control means 44, and is coaxial with the piston 47. The detecting rod 65 is oil-tightly and movably passed through the lid member 48 to protrude into the lift sensor 64. Thus, the lift sensor 64 detects the amount of operation or movement of the detecting rod 65 integrally connected to the control rod 51 through the piston 47, and directly detects the amount of operation of the control rod 51.

The exhaust-side valve operating device $29E_1$ is constructed in the same manner as the intake-side valve operating device $29I_1$ and includes a rotational-amount control means (not shown), an auxiliary-force applying means 56E and the like.

The operation of the first embodiment will be described below with reference to the intake-side valve operating device $29I_1$ taken as an example. Among the three components forming the power transmitting means $30I_1$ of a planetary gear type comprising the sun gear $31_1$, the ring gear $32_1$ and the carrier $33_1$, the sun gear $31_1$ is driven by the valve operating cam 37 on the cam shaft 28; the ring gear $32_1$ is operatively connected to the intake valves VI; and the carrier $33_1$ rotated about the sun gear, is continuously controlled by the rotational-amount control means 44. Therefore, the operational characteristic of the intake valves VI can be continuously changed.

Figures 6A, 6B, 6C:
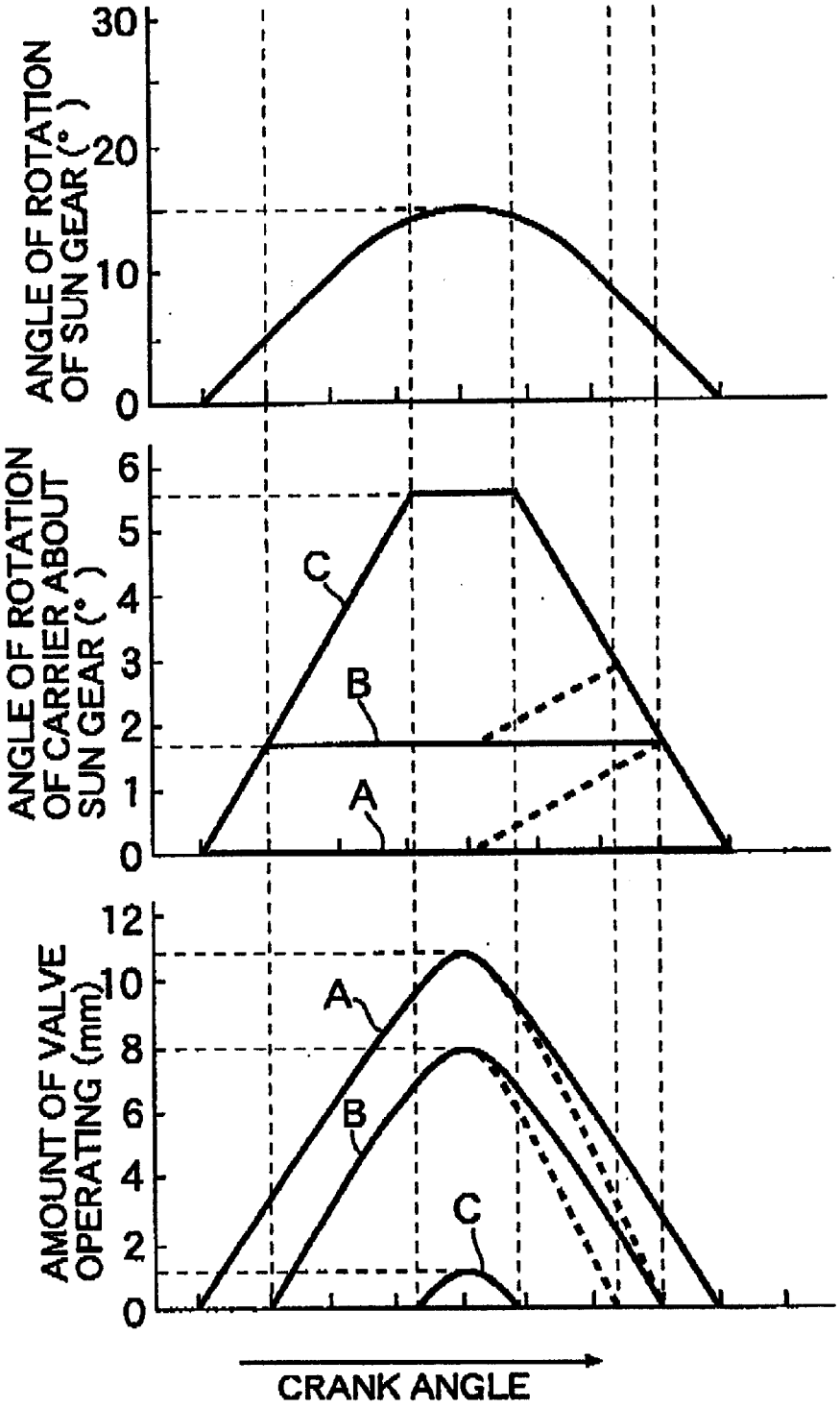
FIGS. 6A, 6B and 6C are diagrams each illustrating a variation in the valve-operational characteristic by definition of rotational angle of carrier.

For example, when the amount of rotation of the carrier $33_1$ about the sun gear is defined to "0" as shown by a character A in FIG. 6B when the sun gear $31_1$ is rotated as shown in FIG. 6A by the valve operating cam 37, the intake valves VI are opened and closed so that the lift amount and opening time assume maximum valves, as shown by a character A in FIG. 6C. When the angle of rotation of the carrier $33_1$ about the sun gear is defined, for example, to 1.6 degrees, as shown by a character B in FIG. 6B, then as shown in FIG. 6C, the intake valves VI are opened and closed, so that the lift amount and opening time shown by character B are smaller than those of the operational characteristic shown by the character A. When the angle of rotation of the carrier $33_1$ about the sun gear is defined, for example, to 5.6 degrees, as shown by a character C in FIG. 6B, the intake valves VI are opened and closed so that the lift amount and opening time are even smaller than those of the operational characteristic shown by the character B as shown by a character C in FIG. 6C. Moreover, the control of the rotation by the rotational-amount control means 44 may be cancelled as shown by the dashed line in FIG. 6B in the middle of the opening and closing of the intake valves VI. If this is done, the time of the closing of the intake valves VI is hastened as shown by the dashed line in FIG. 6C.

The power transmitting means $30I_1$ is constructed so that the three components forming it, i.e., the sun gear $31_1$, the ring gear $32_1$ and the carrier $33_1$ are disposed for rotation about the same axis. Therefore, it is possible to provide a compactness of the power transmitting means $30I_1$ and to reduce the size of the valve operating device $29I_1$. Moreover, because the power transmitting means $30I_1$ is of the planetary gear type, it is possible to accurately control the operational characteristic of the intake valves VI by the meshing connection of the components $31_1$, $32_1$ and $33_1$ comprising the power transmitting means $30I_1$. Yet further, since the cam slipper 38 provided at the tip end of the arm 36 connected to the sun gear $31_1$ on the axially one side of the ring gear $32_1$ and extending toward the cam shaft 28, is in contact with the valve operating cam 37, the cam shaft 28 can be located in proximity to the power transmitting means $30I_1$, while avoiding interference between the valve operating cam 37 and the ring gear $32_1$. Thus, the degree of freedom for disposition of the cam shaft 28 can be increased. In addition, since the cam shaft 28 is disposed so that the projection of the rotational locus L of the outermost end of the valve operating cam 37 intersects the outer peripheral surface of the ring gear $32_1$ as viewed from the axial direction of the cam shaft 28, the cam shaft 28 can be disposed in proximity to the axis of the power transmitting means $30I_1$, thereby providing further compactness to the valve operating device $29I_1$.

The rotational-amount control means 44 is adapted to apply, to the carrier $33_1$, the control force opposing the spring forces of the valve springs 23 which bias the intake valves VI in the closing direction and which are increased in accordance with the opening operation of the intake valves VI, in such a manner that the control force can be continuously changed. Thus, the amount of rotation of the carrier $33_1$ about the sun gear can be continuously controlled by the continuous changing of the control force. Therefore, a hydraulic actuator adapted to change the force exhibited by the control of the hydraulic pressure, can be used as the rotational-amount control means 44 and thus, the rotational-amount control means 44 can be easily constructed. Further, the auxiliary-force applying means 56I is connected to the carrier $33_1$, and the force exhibited by the rotational-amount control means 44 can be set at a relatively small value because a portion of the force opposing the spring forces of the valve springs 23 is provided by the auxiliary-force applying means 56I. Thus, it is possible to provide a reduction in size of the rotational-amount control means 44.

Moreover, the lift sensor 64 is mounted on the rotational-amount control means 44, so that the amount of operation of the control rod 51, i.e., the control amount of rotation of the carrier $33_1$ and the maximum lift amount of the intake valves VI can be detected by the lift sensor 64. Therefore, the operational characteristic of the intake valves VI can be controlled continuously and with high accuracy in correspondence to the operational state of the engine by a feedback control using the detected value detected by the lift sensor 64.

Figure 7:
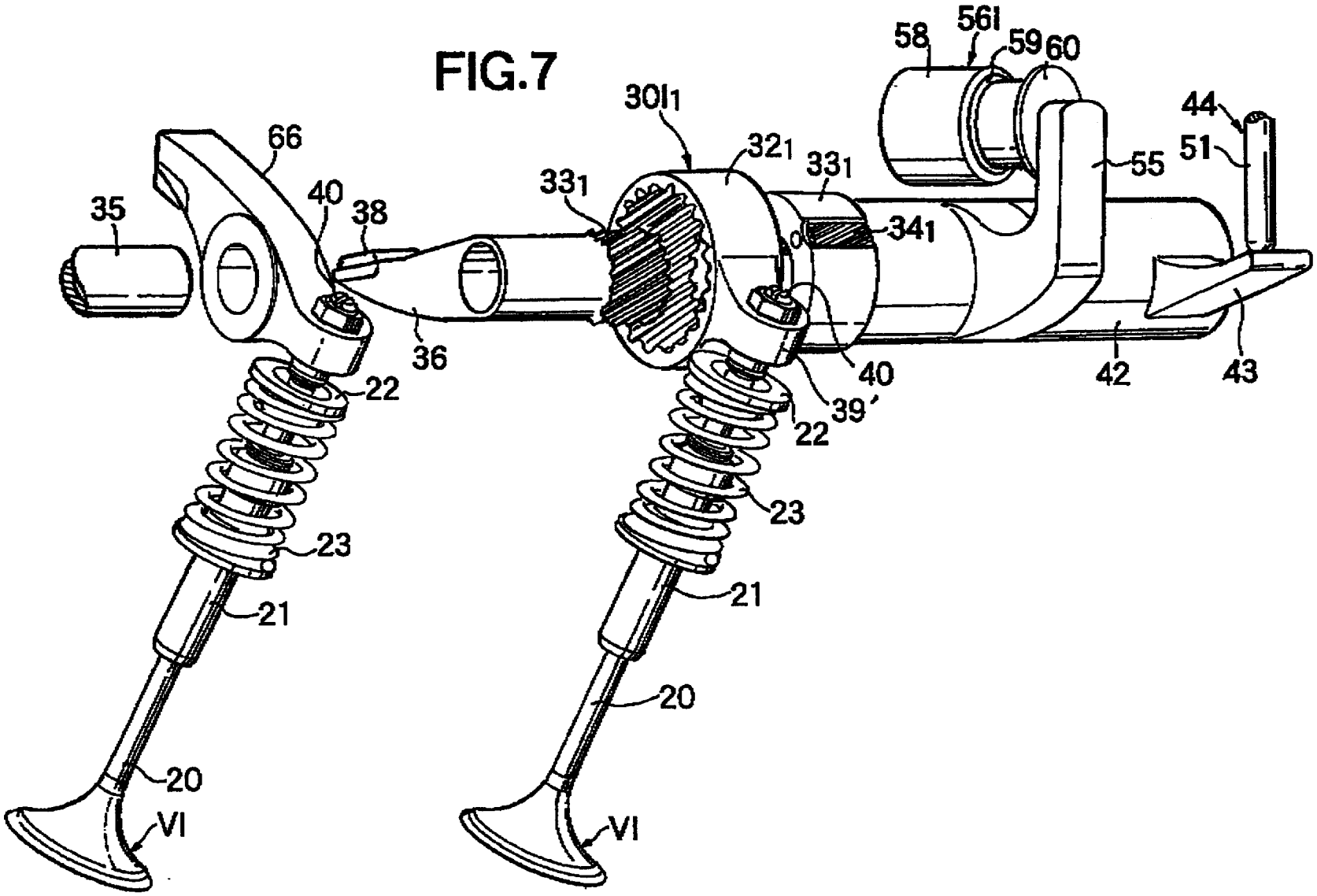
FIG. 7 is an exploded perspective view similar to FIG. 4, but according to a second embodiment of the present invention.

FIG. 7 illustrates a second embodiment of the present invention, wherein components or portions corresponding to those in the first embodiment are designated by like reference characters.

A ring gear $32_1$ in a power transmitting means $30I_1$ is integrally provided with a connecting arm 39' extending toward one of a pair of intake valves VI. A tappet screw 40 connected to an upper end of a stem 20 of the one intake valve VI is threadedly engaged with a tip end of the connecting arm 39' for advancing and retreating movements. Another tappet screw 40 is threadedly engaged for advancing and retreating movements with a rocker arm 66 which is swingably carried on a support shaft 35. The tappet screw 40 is connected to an upper end of a stem 20 of the other intake valve VI. The rocker arm 66 is in sliding contact with a valve operating cam which is different from the valve operating cam 37 (see FIG. 2) adapted to apply a power to a power transmitting means $30I_1$.

According to the second embodiment, the operational characteristic of one of the intake valves VI can be continuously changed, but the other intake valve VI is opened and closed with a fixed operational characteristic.

In a further alternate embodiment of the present invention, the cylindrical member 42 and a rotational-amount control means 44 may be disposed commonly for two adjacent cylinders in a multi-cylinder internal combustion engine. Specifically, in the two adjacent cylinders, the timing of opening of engine valves are displaced along the crank angle and hence, the control force may be exhibited by the rotational-amount control means 44 in correspondence to the timing of opening of the engine valves, respectively. This makes it possible to provide a decrease in number of parts.

FIGS. 8 to 12 illustrate a third embodiment of the present invention, wherein components or portions corresponding to those in each of the above-described embodiments are designated by like reference characters.

Figure 8:
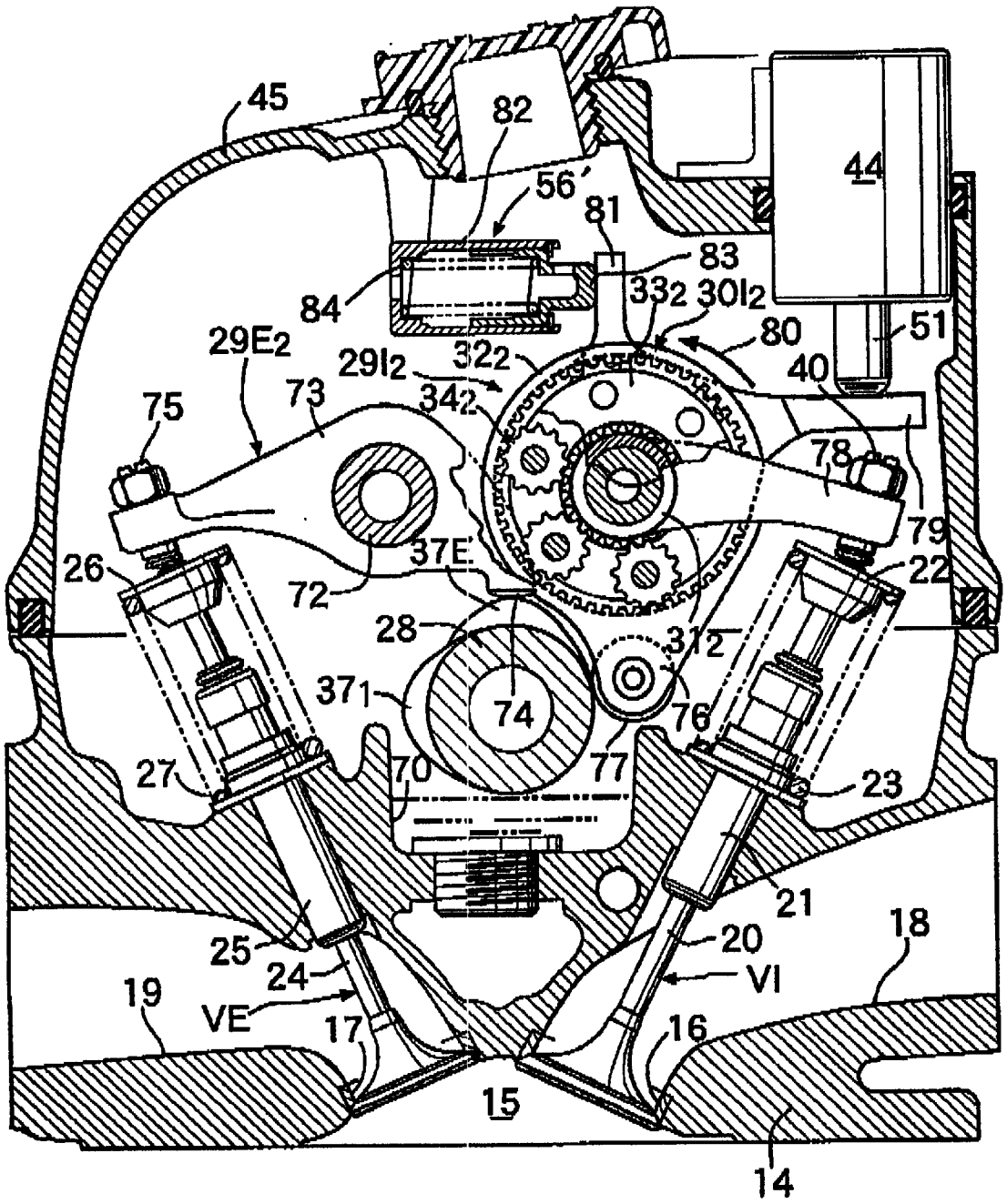
FIG. 8 is a vertical sectional view of an essential portion of an internal combustion engine.

Referring first to FIG. 8, a cam shaft 28 is rotatably disposed between a pair of intake valves VI and a pair of exhaust valves VE in such a manner that it is located below upper ends of the intake valve VI and upper ends of the exhaust valves VE. An oil bath 70 is defined in an upper surface of a cylinder head 14, and the cam shaft 28 is disposed at a location in which an intake-side valve operating cam 37I and an exhaust-side valve operating cam 37E provided on the cam shaft 28 can be immersed in an oil within the oil bath 70.

An intake-side valve operating device $29I_2$ is mounted between the intake valves VI and the intake-side valve operating cam 37I of the cam shaft 28 and capable of converting the rotational movement of the cam shaft 28 into opening and closing movements of the intake valves VI. An exhaust-side valve operating device $29E_2$ is mounted between the exhaust valves VE and the exhaust-side valve operating cam 37E of the cam shaft 28 and capable of converting the rotational movement of the cam shaft 28 into opening and closing movements of the exhaust valves VE.

The exhaust-side valve operating device $29E_2$ includes a rocker arm shaft 72 fixedly disposed and having an axis parallel to the cam shaft 28, and a rocker arm 73 rotatably carried on the rocker arm shaft 72 and provided between the exhaust valves VE and the exhaust-side valve operating cam 37E. A cam slipper 74 is provided at one end of the rocker arm 73 to come into contact with the exhaust-side valve operating cam 37E. A pair of tappet screws 75 in contact with upper ends of the exhaust valves VE, are threadedly inserted into the other ends of the rocker arm 73, so that their advanced and retreated positions can be regulated.

Referring also to FIGS. 9 to 12, the intake-side valve operating device $29I_2$ includes a power transmitting means $30I_2$ which is formed into a planetary gear type by a sun gear $31_2$ which is an inner wheel rotatable about an axis, a ring gear $32_2$ which is an outer wheel surrounding the sun gear $31_2$ for rotation about the same axis as the sun gear $31_2$, and a carrier $33_2$ on which a plurality of planetary gears $34_2$ as planetary rotors are carried for rotation about an axis parallel to axes of the sun gear $31_2$ and the ring gear $32_2$ which is rotated in operative association with the rotation of the planetary gears $34_2$ about the sun gear $31_2$.

Among the sun gear $31_2$, the ring gear $32_2$ and the carrier $33_2$ which are three components comprising the power transmitting means $30I_2$, the sun gear $31_2$ is rotatably carried on a support shaft 35 fixedly disposed between the cam shaft 28 and the intake valves VI and having an axis parallel to the axis of the cam shaft 28. An arm 76 extending toward the cam shaft 28 is integrally provided on the ring gear $32_2$. A roller 77 is rotatably supported at the tip end of the arm 76 and is in contact with the intake-side valve operating cam 37I on the cam shaft 28. Thus, the ring gear $32_2$ is operatively connected to the intake-side valve operating cam 37I on the cam shaft 28 and driven by the intake-side valve operating cam 37I in response to the rotation of the cam shaft 28. Moreover, the point of operative connection of the ring gear $32_2$ to the intake-side valve operating cam 37, i.e., the point of contact of the roller 77 with the intake-side valve operating cam 37I is disposed at a location in proximity to the oil bath 70 between the intake valves VI and the cam shaft 28.

Connecting arms 78 extend toward the intake valves VI on opposite sides of the ring gear $32_2$ and are secured to the sun gear $31_2$ which is another one of the components of the power transmitting means $30I_2$. Tappet screws 40 in contact with upper ends of stems 20 of the intake valves VI, are threadedly inserted into tip ends of the connecting arms 78, respectively for advancing and retreating movements. Thus, the sun gear $31_2$ is operatively connected to the intake valves VI, so that the intakes valves VI are opened and closed in response to the rotation of the sun gear $31_2$.

The carrier $33_2$ which is the remainder of the three components of the power transmitting means $30I_2$ is coaxially inserted between the sun gear $31_2$ and the ring gear $32_2$ and includes support plates 33*a*' at opposite ends thereof. The planetary gears $34_2$ meshed with an outer periphery of the sun gear $31_2$ and an inner periphery of the ring gear $32_2$, are disposed at a plurality of, e.g., six points equally spaced apart from one another in a circumferential direction of the carrier $33_2$, and each rotatably supported at opposite ends thereof by the support plates 33*a'*.

One of the support plates 33*a'* provided on the carrier $33_2$ is integrally provided with a control arm 79 extending on the opposite side from the cam shaft 28. A rotational-amount control means 44 is disposed in the head cover 45 at a location above the control arm 79 and includes a control rod 51 which is in contact with an upper surface of the control arm 79.

Figure 9:
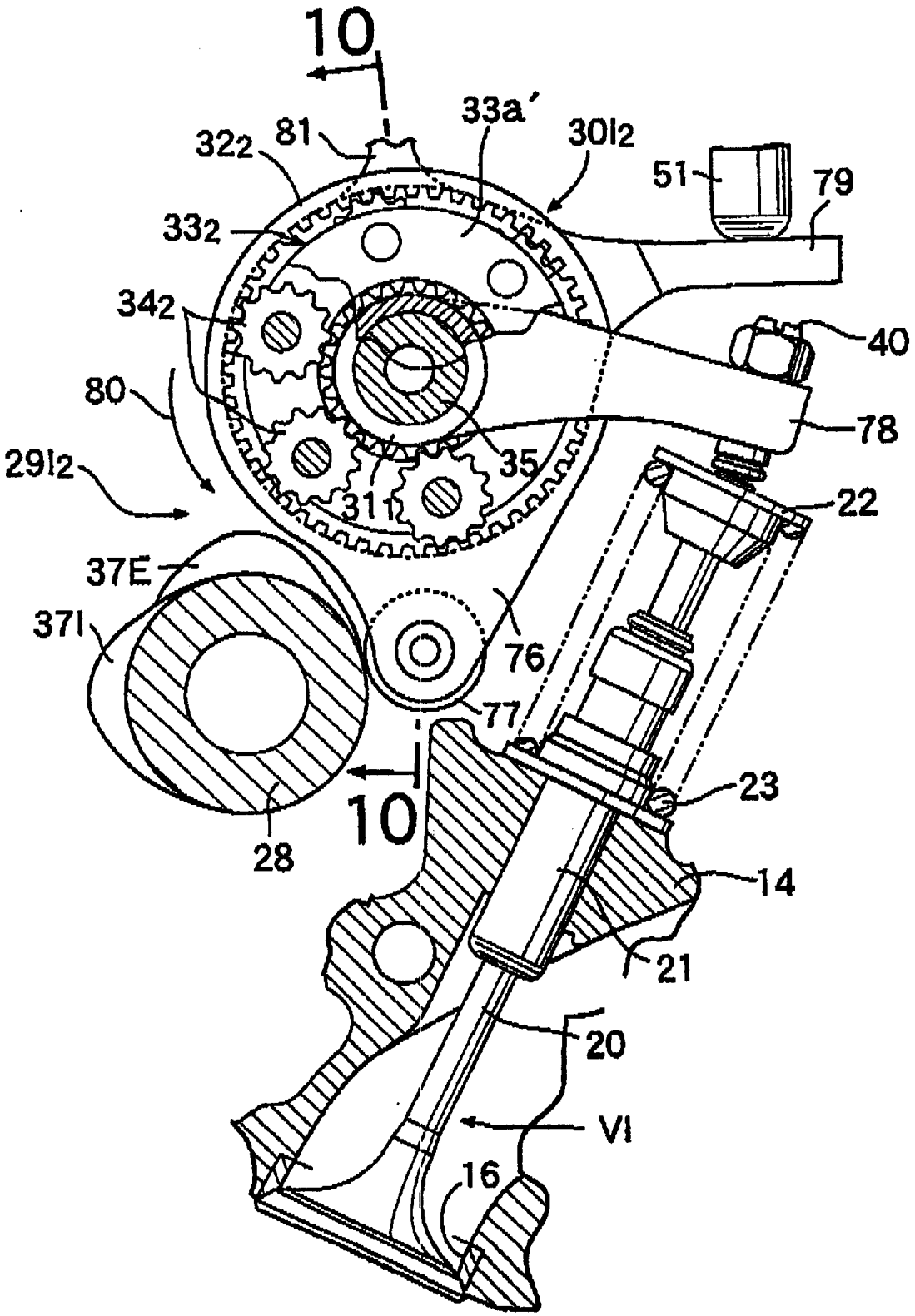
FIG. 9 is an enlarged view of the essential portion shown in FIG. 8.
Figure 10:
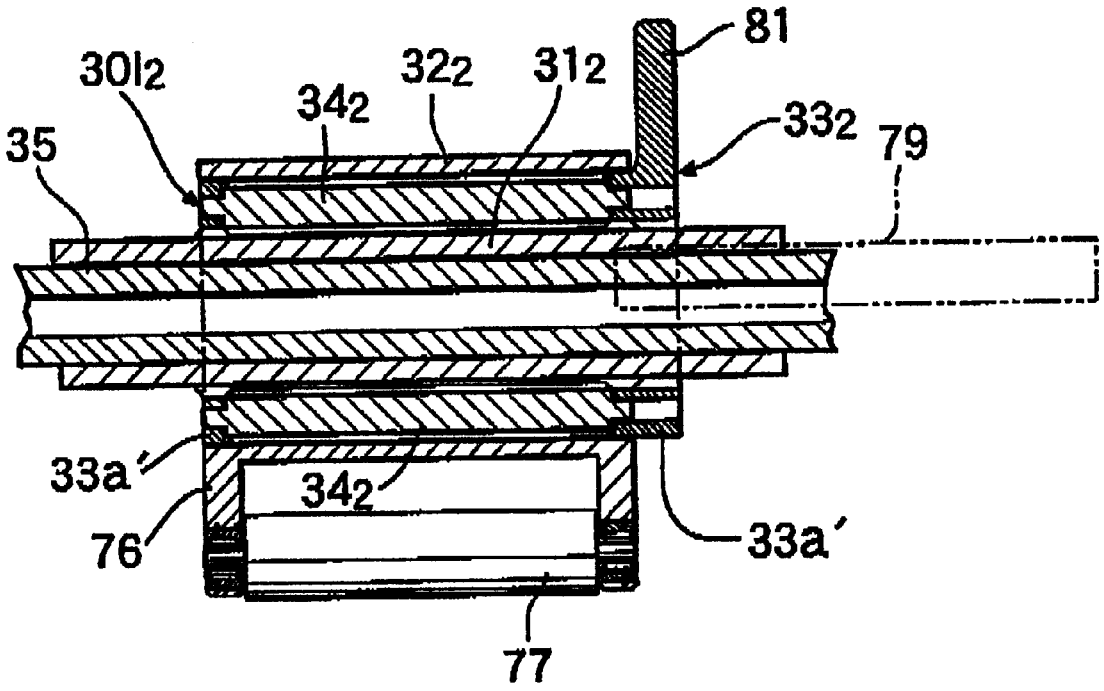
FIG. 10 is a sectional view taken along a line 10—10 in FIG. 9.
Figure 11:
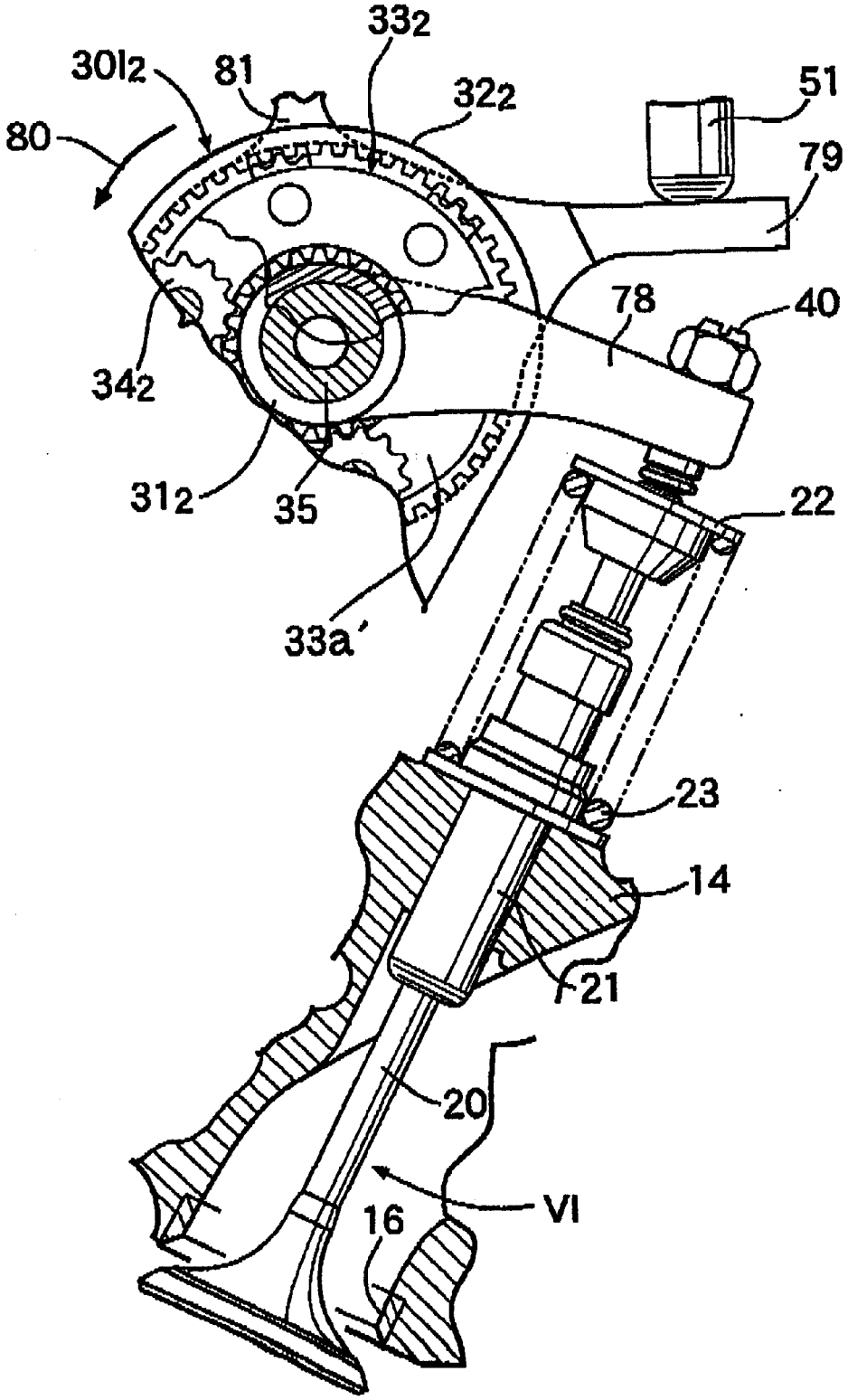
FIG. 11 is a sectional view similar to FIG. 9, but taken when an engine valve is opened.
Figure 12:
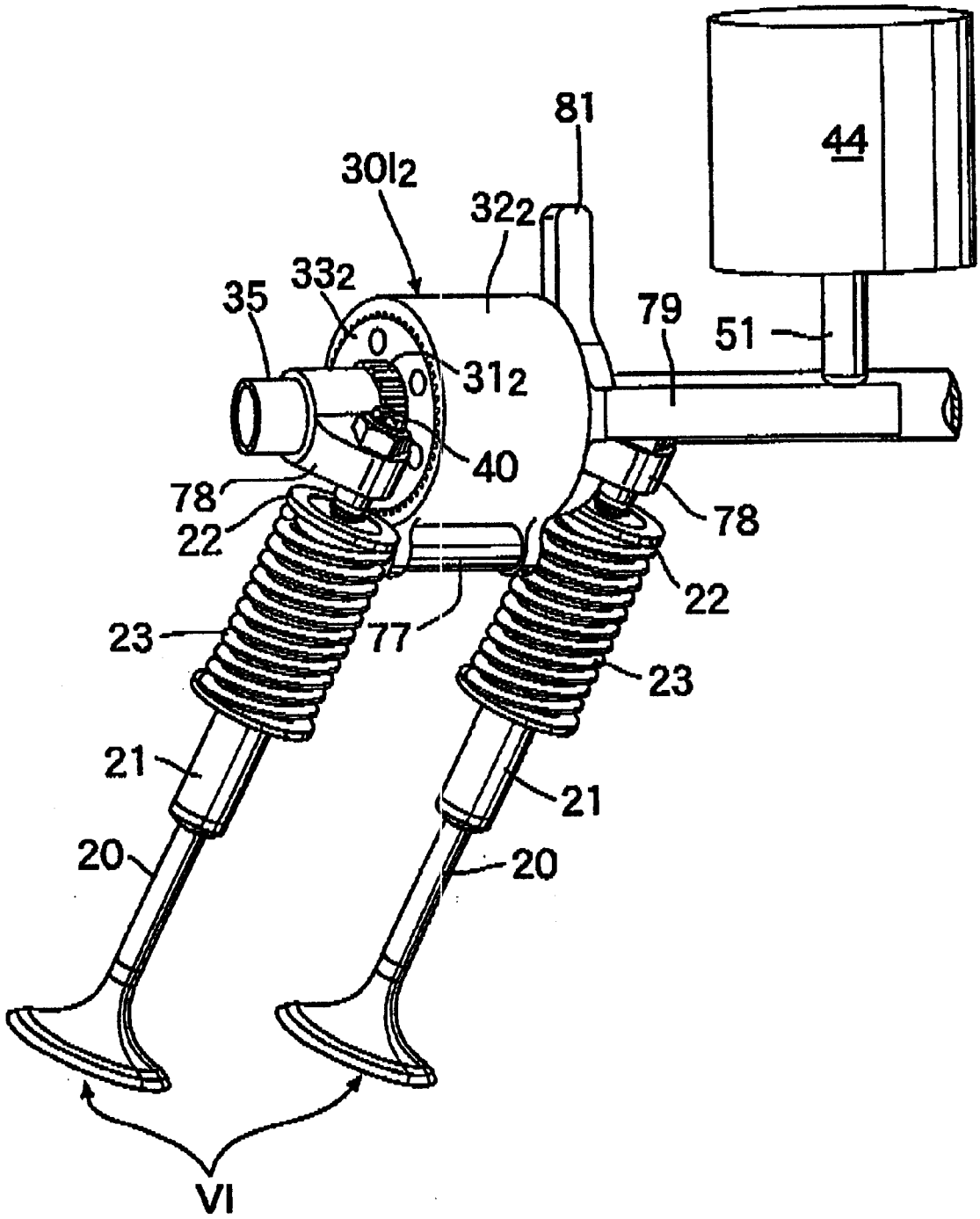
FIG. 12 is a perspective view of an intake valve operating device.

The ring gear $32_2$ is rotated in a direction indicated by an arrow 80 in FIGS. 8, 9 and 11 by pushing of the arm 76 by the intake-side valve operating cam 37I. However, a relatively large spring load, for example, of about 20 kgf is applied to the intake valves VI and the sun gear $31_2$ by the valve springs 23 and hence, when the rotation of the carrier $33_2$ about the sun gear $31_2$ is not controlled, the carrier $33_2$ is freely rotated in the same direction as the arrow 80, and the intake valves VI cannot be opened and closed. However, when the rotation of the carrier $33_2$ about the sun gear $31_2$ is controlled, each of the planetary gears $34_2$ is rotated about its axis by an amount corresponding to a controlled rotational amount to cause the rotation of the ring gear $32_2$, thereby opening the intake valves VI. Thus, the maximum lift amount and the opening timing, i.e., the operational characteristic of the intake valves VI can be changed continuously by continuously changing the controlled rotational amount of the carrier $33_2$.

The rotational-amount control means 44 continuously controls the rotational amount of the carrier $33_2$ about the sun gear $31_2$. Thus, whereas the spring forces of the valve springs 23 for biasing the intake valves VI in closing directions are applied to the carrier $33_2$ through the sun gear $31_2$ and the planetary gears $34_2$ to bias the control arm 79 upwards, a force of urging the control arm 79 downwards can be continuously changed. The spring force of the valve springs 23 are increased in accordance with the operation of the intake valves VI in the opening direction of the intake valves VI, and the force for urging the control arm 79 upwards is also increased in accordance with the opening operation of the intake valves VI. Therefore, the changing of the force exhibited by the rotational-amount control means 44 ensures that when the intake valves VI are opened to a certain opening degree, the forces applied to the control arm 79 from above and below are balanced with each other. Thus, the rotational amount of the carrier $33_2$ is controlled to such position, and the maximum lift position of the intake valves VI is controlled to the position in which the forces have been balanced with each other, as described above.

If the force opposing the relatively large spring forces provided by the valve springs 23 is born by only the rotational-amount control means 44, it leads to an increase in size of the rotational-amount control means 44. Therefore, an upward extending auxiliary control arm 81 is integrally provided on the one support plate 33*a'* on the carrier $33_2$, and an auxiliary-force applying means 56' is operatively connected to the auxiliary control arm 81.

The auxiliary-force applying means 56' includes a support tube 82 fixedly supported on the head cover 45, a piston 83 slidably received in the support tube 82 with its one end being in contact with the auxiliary control arm 81, and a spring 84 which is mounted between the support tube 82 and piston 83. The spring 84 exhibits a spring force in a direction to urge the piston 83 against the auxiliary control arm 81.

With such auxiliary-force applying means 56', the spring force exhibited by the spring 84 can be applied to the auxiliary control arm 81 and thus to the carrier $33_2$ in the same direction as the control force from the rotational-amount control means 44, so that a portion of the force opposing the spring forces of the valve springs 23 can be provided by the auxiliary-force applying means 56'.

The operation of the third embodiment will be described below. The three components forming the power transmitting means $30I_2$ of the planetary gear type in the intake-side valve operating device $29I_2$, are the sun gear $31_2$, the ring gear $32_2$ and the carrier $33_2$, the ring gear $32_2$ and the sun gear $31_2$ are operatively connected to the intake-side valve operating cam 37I on the cam shaft 28 and the intake valves VI, respectively, and the amount of carrier $33_2$ rotated about the sun gear is continuously controlled by the rotational-amount control means 44. Therefore, the operational characteristic of the intake valves VI can be continuously and finely controlled.

The power transmitting means $30I_2$ is of the planetary gear type in which the three components comprising the power transmitting means $30I_2$, i.e., the sun gear $31_2$, the ring gear $32_2$ and the carrier $33_2$ are disposed for rotation about the same axis. Therefore, it is possible to provide a compact power transmitting means $30I_2$ and reduce the size of the valve operating device $29I_2$, and it is possible to accurately control the operational characteristic of the intake valves VI by the meshing connection of the components $31_2$, $32_2$ and $33_2$ forming the power transmitting means $30I_2$.

In such power transmitting means $30I_2$, the amount of rotation of the ring gear $32_2$ is smaller than that of the sun gear $31_2$, and the ring gear $32_2$ is operatively connected to the intake-side valve operating cam 37I on the cam shaft 28, while the sun gear $\mathbf{31}_2$ is operatively connected to the intake valves VI. Therefore, the lift amount required for the intake valves VI, i.e., the size of the intake-side valve operating cam 37I suitable for the amount of rotation of the sun gear $\mathbf{31}_2$ can be set at a relatively small value. Thus, the load received from the intake-side valve operating cam 37I by the ring gear $\mathbf{32}_2$ can be relatively decreased to contribute to the alleviation of the valve operating load. The roller 77 supported on the arm 76 of the ring gear $\mathbf{32}_2$ is in rolling contact with the intake-side valve operating cam 37I and hence, the valve operating load can be further decreased. Further, because of the relatively small intake-side valve operating cam 37I, the space required for rotation of the intake-side valve operating cam 37I as well as the space required for operation of the arm 76 of the ring gear $\mathbf{32}_2$ can be also reduced, thereby providing a compact valve operating chamber for the disposition of the intake-side valve operating device $\mathbf{29I}_2$.

Moreover, since the single ring gear $\mathbf{32}_2$ is disposed between a pair of intake valves VI adjacent each other in the direction parallel to the axis of the cam shaft 28, and the intake valves VI are operatively connected to the sun gear $\mathbf{31}_2$ on the axially opposite sides of the ring gear $\mathbf{32}_2$, the pair of intake valves VI, whose operational characteristic can be changed, can be opened and closed by the power transmitting means $\mathbf{30I}_2$ disposed compactly between the intake valves VI, and the intake-side valve operating device $\mathbf{29I}_2$ can be made compact.

Further, since the cam shaft 28 is disposed at the location between the intake valves VI and the exhaust valves VE and below the upper ends of the intake valves VI and the exhaust valves VE, and the point of operative connection of the intake-side valve operating cam 37I with the ring gear $\mathbf{32}_2$ is disposed between the intake valves VI and the cam shaft 28, the power transmitting means $\mathbf{30I}_2$ can be disposed in proximity to the upper surface of the cylinder head 14, thereby providing compactness of the valve operating chamber. Moreover, since the intake-side and exhaust-side valve operating cams 37I and 37E are immersed in the oil within the oil bath defined in the upper surface of the cylinder head 14, the lubrication of the power transmitting means $\mathbf{30I}_2$ can be satisfactorily performed by raking up the oil with the intake-side and exhaust-side valve operating cams 37I and 37E. In this case, the oil raked up by the intake-side and exhaust-side valve operating cams 37I and 37E can be effectively scattered toward the power transmitting means $\mathbf{30I}_2$ to more effectively perform the lubrication of the power transmitting means $\mathbf{30I}_2$ by the fact that the cam shaft 28 is rotated in a counterclockwise direction as viewed in FIG. 8. In addition, the lubrication of the roller 77 can be also satisfactorily performed because the point of operative connection of the intake-side valve operating cam 37I and the ring gear $\mathbf{32}_2$, i.e., the point of contact of the roller 77 with the intake-side valve operating cam 37I is in proximity to the oil bath 70.

Figure 13:
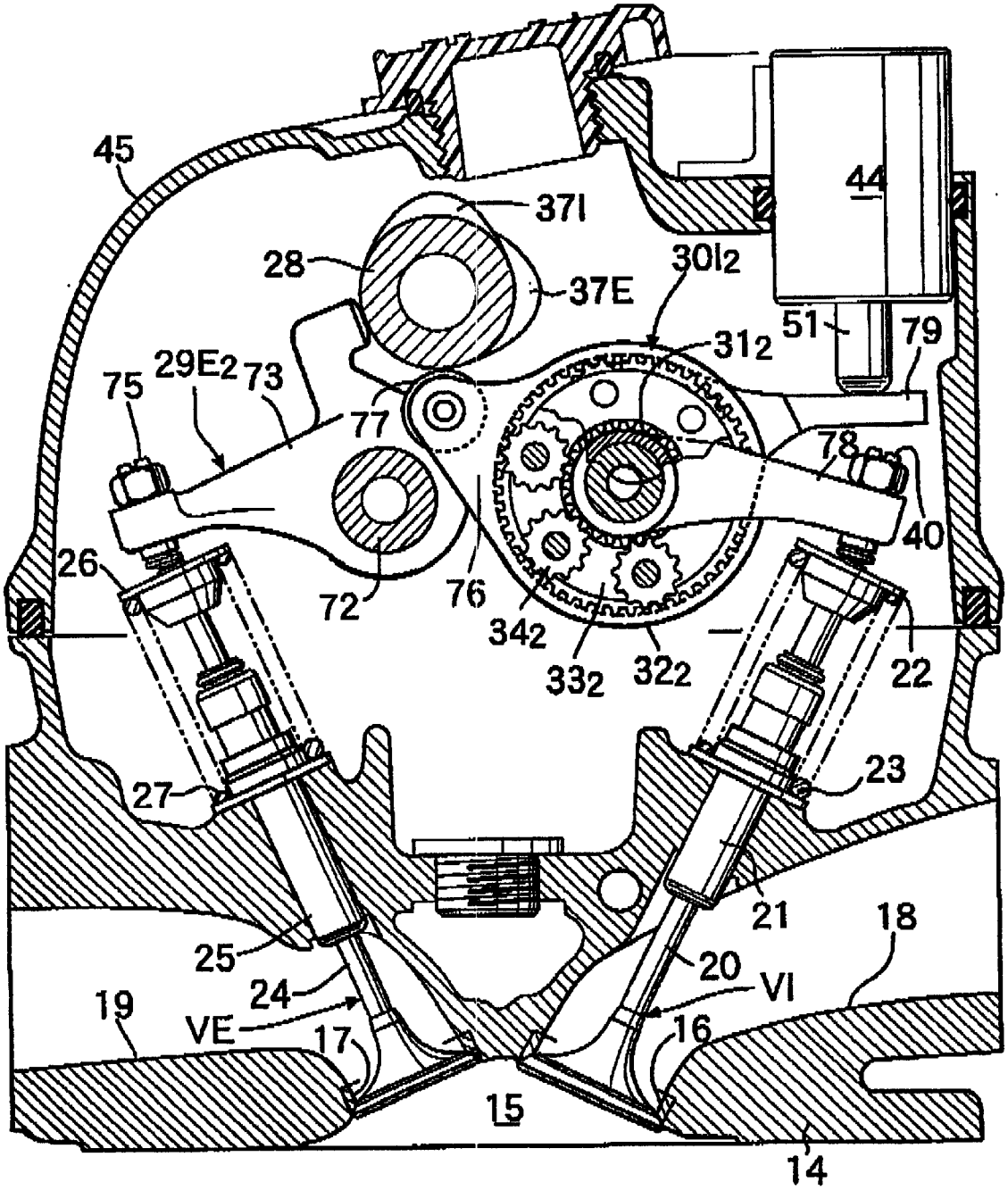
FIG. 13 is a vertical sectional view similar to FIG. 8, but according to a fourth embodiment of the present invention.

FIG. 13 illustrates a fourth embodiment of the present invention. A cam shaft 28 is disposed above the upper ends of the intake valves VI and the exhaust valves VE, and the auxiliary-force applying means 56' is omitted.

In the fourth embodiment, it is impossible to rake up the oil with the intake-side and exhaust-side valve operating cams 37I and 37E to perform the lubrication of the power transmitting means $\mathbf{30I}_2$, but the other portions or components can provide similar effects to those in the third embodiment.

Figure 14:
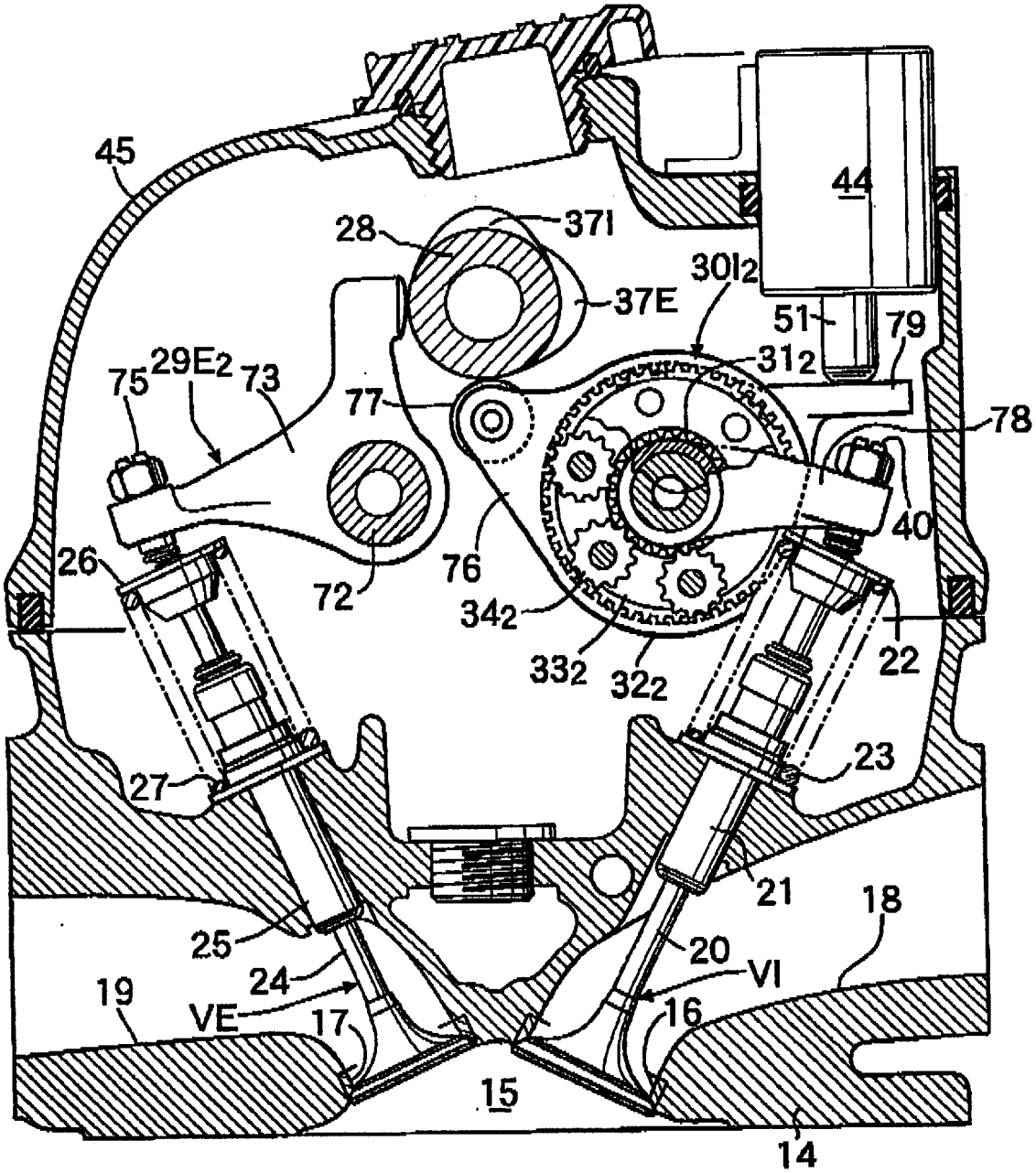
FIG. 14 is a vertical sectional view similar to FIG. 8, but according to a fifth embodiment of the present invention.

FIG. 14 illustrates a fifth embodiment of the present invention. A power transmitting means $\mathbf{30I}_2$ is disposed in such a manner that a projection of a portion of the ring gear $\mathbf{32}_2$ is superposed on a portion of a coiled valve spring 23 surrounding an upper portion of each of the intake valves VI, as viewed in the axial direction of the ring gear $\mathbf{32}_2$. Thus, the power transmitting means $\mathbf{30I}_2$ can be disposed in closer proximity to the intake valves VI, whereby the valve operating chamber can be made compact.

Figure 15:
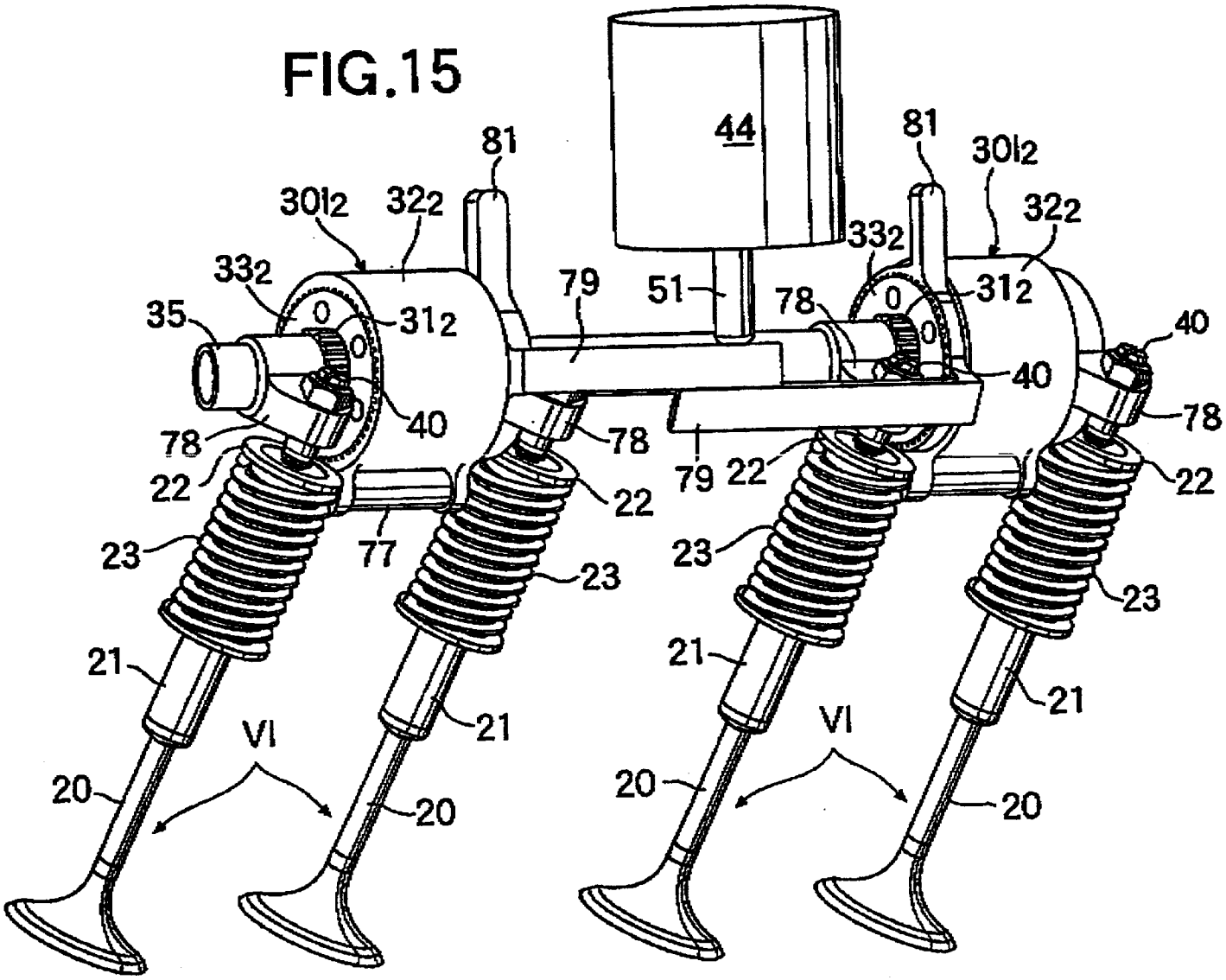
FIG. 15 is a perspective view similar to FIG. 12, but according to a sixth embodiment of the present invention.

FIG. 15 illustrates a sixth embodiment of the present invention. A rotational-amount control means 44 may be disposed commonly for two adjacent cylinders whose opening periods are not overlapped with each other in a multi-cylinder internal combustion engine. Specifically, in the two adjacent cylinders whose opening periods are not overlapped with each other, the control force may be exhibited synchronously with the opening time of each of the cylinders by the rotational-amount control means 44. Thus, it is possible to provide a decrease in the number of parts.

In this case, control arms 79 in the power transmitting means $\mathbf{30I}_2$ for the two adjacent cylinders may be superposed on each other, and the control rod 51 of the rotational-amount control means 44 may be disposed to come into contact with the superposed portions of the control arms 79. Alternatively, the control arms 79 of the power transmitting means $\mathbf{30I}_2$ for the two adjacent cylinders may be formed integrally with each other.

In all of the above embodiments, any of a linear solenoid, a step motor and the like may be used as the rotational-amount control means. When a step motor is used, one of the three components of the power transmitting means, whose rotational amount is controlled by the step motor, can be mechanically locked and hence, it is possible to enhance the accuracy of control of the valve operational characteristics and to reduce the size of the valve operating device.

Planetary friction-type power transmitting means (traction drives) as disclosed in Japanese Patent Application Laid-open Nos. 5-33840, 5-79450, 5-157149, 6-34005 and 6-66360 may be used as the power transmitting means.

The rotational amount of one of the three components comprising the power transmitting means, which is operatively connected to the rotational-amount control means, can be controlled at a plurality of stages rather than continuously, and in this case, the operational characteristics of the engine valves can be finely controlled by setting the number of stages to a larger value.

In changing the valve operational characteristic, only one of the lift amount and timing of opening of the engine valve needs to be changed.

Although the embodiments of the present invention have been described above in detail, it will be understood that the present invention is not limited to the above-described embodiments, and various modifications in design may be made without departing from the spirit and scope of the invention defined in claims.

What is claimed is:

1. A valve operating system for an internal combustion engine wherein the operational characteristic of an engine valve can be changed in accordance with the operational state of the engine, said valve operating system comprising:

(a) a power transmitting means having three components:

(i) an inner wheel for rotation about an axis, (ii) an outer wheel for rotation about said axis and surrounding said inner wheel, and (iii) a carrier member having a planetary rotor disposed between said inner and outer wheels for rotation about an axis parallel to said axis of said inner and outer wheels, wherein said carrier member is rotated in operative association with the revolution of said planetary rotor about said inner wheel;

(b) a cam shaft and a valve operating cam mounted on said cam shaft, wherein one of said three components is operatively connected to said valve operating cam such that said one component is rotated in response to the rotation of said cam shaft, and wherein another of said three components is connected to said engine valve; and (c) a rotational-amount control means operatively connected to the remaining of said three components for controlling the rotational amount of said third component to be continuously variable in accordance with the operational state of the engine.

2. A valve operating system in an internal combustion engine according to claim 1, wherein said power transmitting means is a planetary gear mechanism and wherein said inner wheel is a sun gear, said outer wheel is a ring gear, and said carrier member includes at least one planetary gear carried thereon.

3. A valve operating system in an internal combustion engine according to claim 2, including an arm having a tip end connected to said sun gear, wherein the engine valve is connected to said ring gear, said arm extends toward said cam shaft and is disposed on one side of said ring gear; and the tip end of said arm is in contact with said valve operating cam, and wherein said cam shaft has an axis parallel to the axis of said power transmitting means, and said rotational-amount control means is connected to said carrier.

4. A valve operating system in an internal combustion engine according to claim 3, wherein said cam shaft is disposed at a location such that the projection of the locus of rotation of the outermost end of said valve operating cam intersects an outer peripheral surface of said ring gear, as viewed in the axial direction of said cam shaft.

5. A valve operating system in an internal combustion engine according to claim 1, wherein the axes of said inner and outer wheels are positioned between said cam shaft and said engine valve, in parallel with said cam shaft.

6. A valve operating system in an internal combustion engine according to claim 1, wherein the axis of said inner wheel and said outer wheel is disposed at a position different from an axis of said cam shaft.

7. A valve operating system in an internal combustion engine according to claim 1, wherein said rotational-amount control means is capable of controlling the rotational amount of said third component to change the operational characteristic of the engine valve such that at least one of a lift amount and an opening time of said engine valve assumes a predetermined intermediate value between a maximum value and a minimum value, said minimum value representing a substantially stopped state of the engine valve.

8. A valve operating system in an internal combustion engine according to claim 2, wherein the engine includes a plurality of valves and wherein said single power transmitting means is mounted between said cam shaft and said plurality of said engine valves.

9. A valve operating system in an internal combustion engine according to claim 8, wherein said plurality of engine valves are disposed in a row in a direction parallel to the axis of said cam shaft, and said ring gear of said power transmitting means is disposed between said engine valves at opposite ends in a direction of arrangement of the engine valves as viewed in a direction perpendicular to the axis of said cam shaft.

10. A valve operating system in an internal combustion engine according to claim 2, wherein said power transmitting means is mounted between said cam shaft and a pair of the engine valves arranged in a direction parallel to the axis of said cam shaft, and wherein said ring gear is disposed between said pair of engine valves as viewed in a direction perpendicular to the axis of said cam shaft.

11. A valve operating system for an internal combustion engine, wherein the operational characteristic of an engine valve can be changed in accordance with the operational state of the engine, said valve operating system comprising:

(a) a power transmitting means having three components:

(i) an inner wheel for rotation about an axis, (ii) an outer wheel for rotation about said axis and surrounding said inner wheel, and (iii) a carrier member having a planetary rotor disposed between said inner and outer wheels for rotation about an axis parallel to said axis of said inner and outer wheels, wherein said carrier member is rotated in operative association with the revolution of said planetary rotor about said inner wheel;

(b) a cam shaft and a valve operating cam mounted on said cam shaft, wherein one of said three components is operatively connected to said valve operating cam such that said one component is rotated in response to the rotation of said cam shaft, and wherein another of said three components is connected to said engine valve; and (c) a rotational-amount control means operatively connected to the remaining of said three components for controlling the rotational amount of said third component to be continuously variable in accordance with the operational state of the engine, wherein said outer wheel as said one component is operatively connected to said valve operating cam on said cam shaft; said inner wheel as said another component is connected to said engine valve; and said carrier as said third component is connected to said rotational-amount control means.

12. A valve operating system in an internal combustion engine according to claim 11, wherein said power transmitting means is a planetary gear mechanism and wherein said inner wheel is a sun gear, said outer wheel is a ring gear, and said carrier member includes at least one planetary gear carried thereon.

13. A valve operating system in an internal combustion engine according to claim 11, wherein said cam shaft is positioned at a location below the upper ends of intake and exhaust valves of the engine and between the intake and exhaust valves of the engine, and the point of operative connection of the valve operating cam and said outer wheel is located between said cam shaft and one of the intake and exhaust valves, operatively connected to said inner wheel, whereby the operational characteristic of the one of the intake and exhaust valves can be changed.

14. A valve operating system in an internal combustion engine according to claim 13, further including an oil bath formed in the upper surface of the cylinder head of the engine, said valve operating cam being immersed in oil within said oil bath.

15. A valve operating system in an internal combustion engine according to claim 11, wherein a single outer wheel is disposed between a pair of adjacent engine valves, and both said engine valves are operatively connected to said inner wheel on an axially opposite side of said outer wheel.

16. A valve operating system in an internal combustion engine according to claim 11, including a coiled valve spring which surrounds an upper portion of the engine valve to exhibit a spring force for biasing said engine valve in a closing direction, wherein said power transmitting means is positioned such that the projection of a portion of said outer wheel is superimposed, as viewed in an axial direction of said outer wheel, on a portion of said coiled valve spring.

17. A valve operating system in an internal combustion engine according to claim 11, wherein said rotational-amount control means applies a changeable force opposing a reaction force transmitted to said third component through said another component; said valve operating system further comprising:

a spring that biases said engine valve in a closing direction, the resilient force of said spring increasing in accordance with the operation of said engine valve in an opening direction; and auxiliary-force applying means connected to said third component that bears a portion of the force opposing the reaction force.

18. A valve operating system in an internal combustion engine according to claim 11, wherein said rotational-amount control means includes an operating member connected to said third component to control the rotational amount of said third component, and said valve operating system further comprises:

detecting means for detecting the amount of movement of said operating member.

19. A valve operating system in an internal combustion engine according to claim 18, wherein said rotational-amount control means controls the rotational amount of said third component using detected values of said detecting means in a feed-back manner.

20. A valve operating system in an internal combustion engine, wherein the operational characteristic of a valve of the engine can be changed in accordance with the operational state of the engine, said valve operating system comprising:

a cam shaft and a valve operating cam mounted thereof;

a first power transmitting member driven in rotation about an axis by said valve operating cam;

a second power transmitting member operatively coupled to and driven by said first power transmitting member, wherein, said second power transmitting member is rotated about said axis of said first power transmitting member in a plane perpendicular to said rotational axis of said first power transmitting member, and wherein said second power transmitting member is adapted to drive the engine valve; and a control means for continuously changing the amount of power transmitted between said first and second power transmitting members in accordance with the operation state of the engine, wherein said control means includes a control mode that places said first and second power transmitting members in a state in which said engine valve is substantially stopped.

21. A valve operating system in an internal combustion engine according to claim 20, wherein said rotational axis of said first power transmitting member is disposed in parallel with said cam shaft, between said cam shaft and said engine valve.

22. A valve operating system in an internal combustion engine according to claim 20, further including a planetary gear mechanism having three components, mounted between said first and second power transmitting members, wherein said control means is connected to one of the components of said planetary gear mechanism, and said first and second power transmitting members are connected to the other components of said planetary gear mechanism, for controlling the amount of operation of said one component.

23. A valve operating system in an internal combustion engine according to claim 20, further comprising:

a third power transmitting member associated with said second power transmitting member, wherein said control means includes an operating member connected to said third power transmitting member to control the amount of power transmitted at said third power transmitting member; and detecting means for detecting the amount of power received by said operating member.

24. A valve operating system in an internal combustion engine according to claim 23, wherein said control means controls the amount of power transmitted at said third power transmitting member using detected values of said detecting means in a feed-back manner.

25. A valve operating system in an internal combustion engine according to claim 20, wherein the axis of said first and second power transmitting members is disposed at a position different from an axis of said cam shaft.

26. A valve operating system in an internal combustion engine according to claim 20, further comprising:

a third power transmitting member associated with said second power transmitting member, wherein said control means applies a changeable force opposing a reaction force transmitted to said third power transmitting member through said second power transmitting member;

said valve operating system including a spring for biases said engine valve in a closing direction, the resilient force of said spring increases in accordance with the operation of said engine valve in an opening direction; and auxiliary-force applying means connected to said third power transmitting member and bearing a portion of the force opposing the reaction force.

27. A valve operating system for an internal combustion engine wherein the operational characteristic of an engine valve can be changed in accordance with the operational state of the engine, said valve operating system comprising:

(a) a power transmitting means having three components:

(i) an inner wheel for rotation about an axis, (ii) an outer wheel for rotation about said axis and surrounding said inner wheel, and (iii) a carrier member having a planetary rotor disposed between said inner and outer wheels for rotation about an axis parallel to said axis of said inner and outer wheels, wherein said carrier member is rotated in operative association with the revolution of said planetary rotor about said inner wheel;

(b) a cam shaft and a valve operating cam mounted on said cam shaft, wherein one of said three components is operatively connected to said valve operating cam such that said one component is rotated in response to the rotation of said cam shaft, and wherein another of said three components is connected to said engine valve; and (c) a rotational-amount control means operatively connected to the remaining of said three components for controlling the rotational amount of said third component to be continuously variable in accordance with the operational state of the engine, wherein said rotational-amount control means applies a changeable force opposing a reaction force transmitted to said third component through said another component; said valve operating system including a spring for biasing said engine valve in a closing direction, the resilient force of said spring increasing in accordance with the operation of said engine valve in an opening direction; and an auxiliary-force applying means connected to said third component and adapted to bear a portion of the force opposing the reaction force.

28. A valve operating system for an internal combustion engine wherein the operational characteristic of an engine valve can be changed in accordance with the operational state of the engine, said valve operating system comprising:

(a) a power transmitting means having three components:

(i) an inner wheel for rotation about an axis, (ii) an outer wheel for rotation about said axis and surrounding said inner wheel, and (iii) a carrier member having a planetary rotor disposed between said inner and outer wheels for rotation about an axis parallel to said axis of said inner and outer wheels, wherein said carrier member is rotated in operative association with the revolution of said planetary rotor about said inner wheel;

(b) a cam shaft and a valve operating cam mounted on said cam shaft, wherein one of said three components is operatively connected to said valve operating cam such that said one component is rotated in response to the rotation of said cam shaft, and wherein another of said three components is connected to said engine valve; and (c) a rotational-amount control means operatively connected to the remaining of said three components for controlling the rotational amount of said third component to be continuously variable in accordance with the operational state of the engine, wherein said rotational-amount control means includes an operating member connected to said third component to control the rotational amount of said third component, and said valve operating system includes a detecting means for detecting the amount of movement of said operating member.

29. A valve operating system in an internal combustion engine according to claim 28, wherein said detecting means is mounted on said rotational-amount control means.

30. A valve operating system in an internal combustion engine according to claim 28, wherein said rotational-amount control means controls the rotational amount of said third component using detected values of said detecting means in a feed-back manner.

31. A valve operating system in an internal combustion engine, wherein the operational characteristic of a valve of the engine can be changed in accordance with the operational state of the engine, said valve operating system comprising:

a power transmitting means comprising a sun gear having a rotational axis, said sun gear rotating about said rotational axis, a ring gear for rotation about said rotational axis of said sun gear and surrounding said sun gear, and a carrier including a planetary gear positioned between said sun gear and said ring gear and carried for rotation about an axis parallel to said rotational axis of said sun gear, wherein said carrier is rotated in operative association with the revolution of said planetary gear about said sun gear;

a cam shaft and a valve operating cam mounted thereon with said power transmitting means mounted between the valve operating cam and said engine valve; and a control means for continuously changing the amount of power transmitted between the valve operating cam and the engine valve by said power transmitting means for controlling an amount the carrier is rotated to be continuously variable in accordance with the operational state of the engine.

32. A valve operating system in an internal combustion engine according to claim 31, wherein said rotational axis of said sun gear is positioned between said cam shaft and said engine valve and is parallel to said cam shaft.

33. A valve operating system in an internal combustion engine according to claim 31, wherein the axis of said sun gear and said ring gear is disposed at a position different from an axis of said cam shaft.

* * * * *